US006010239A

United States Patent [19]

Hardgrave et al.

[11] Patent Number: 6,010,239

[45] Date of Patent: Jan. 4, 2000

[54] AUTOMATIC ITEM-DRIVEN SYSTEM FOR DEPOSIT AND PICK-UP

[76] Inventors: William David Hardgrave; Lanna Kay Hardgrave, both of 1933 Westminister, Carrollton, Tex. 75007

[21] Appl. No.: 08/612,243

[22] Filed: Mar. 7, 1996

[51] Int. Cl.[7] ..... A47B 35/00

[52] U.S. Cl. ..... 364/478.01; 364/478.07

[58] Field of Search ..... 340/825.35; 364/478.01, 364/478.02, 478.03, 478.07, 478.08, 478.09, 479.01, 479.02, 479.06, 479.07, 917.8, 918.4; 194/205; 235/382.5, 385, 380, 381, 382, 383, 375, 379, 487; 221/76; 198/411; 414/268

[56] References Cited

U.S. PATENT DOCUMENTS

| | | | |
|---|---|---|---|
| 4,656,463 | 4/1987 | Anders et al. | 340/572 |
| 4,803,348 | 2/1989 | Lohrey et al. | 235/381 |
| 5,113,351 | 5/1992 | Bostic | 264/479 |
| 5,509,572 | 4/1996 | Curtis | 221/76 |

*Primary Examiner*—Thomas Peeso

*Attorney, Agent, or Firm*—Bennett & Weston, P.C.; Thomas V. Malorzo

[57] ABSTRACT

The present invention provides apparatus and methodology for use of an automatic item-driven system for deposit and pick-up in a job-driven environment including access, instructions, item tracking, storage, billing, payment and delivery. The invention is also directed to an automatic deposit machine having logic which is item driven in a job-driven environment wherein automatic systems provide interface between job-driven services and user, as well as an operator's use of the automatic item-driven system to interface between the user either on site or remote locations. A continuous flow automatic deposit machine system provides for customer interface with the system, operator interface with the system and return of finished goods or job-related items to the customer; however, the flow provides various stops in the item, job-related environment due to insufficient information or inappropriate processing demands.

8 Claims, 35 Drawing Sheets

AUTOMATIC ITEM-DRIVEN SYSTEM FOR DEPOSIT AND PICK-UP

FIELD OF THE INVENTION

The invention relates to an automatic deposit machine having logic which is an item-driven system. In another aspect, the invention relates to an automatic item-driven system for issuing articles. In still another aspect the invention relates to an automatic item-driven system for deposit and pick-up of articles such as rental items, laundry and dry cleaning items, special use items and work pieces. In still another aspect the invention relates to uses of an automatic item-driven system for deposit and pick-up in a job-driven environment including access, instructions, item tracking, storage, billing, payment and delivery. In yet another aspect, the invention relates to providing automatic systems which interface between job-driven services and the user. In another aspect, the invention relates to an operator's uses of an automatic item-driven system for receiving, monitoring, communicating, planning, processing and issuing.

BACKGROUND OF THE INVENTION

The development of new and complex apparatus and processes and their use at remote or unattended locations pose unique problems to owners of deposit and pick-up systems. An owner must have the capability of monitoring the deposit and pick-up systems from remote locations as well as being able to receive instructions and to provide billings, security and 24-hour service. Dry cleaning and laundry operators who attempt to provide pick-up and delivery services are confined to specific scheduling and provide such services only when the customer can be present to conduct the transaction. Even after a schedule has been arranged, unforeseen circumstances can occur which cause the customer not to be present or the route driver to be delayed in arriving for pick-up or delivery. These problems resulting in unsuccessful pick-up or delivery attempts and the inconvenience to the customer pose serious problems to the industry.

Attempts have been made to provide apparatus for use with processing establishments such as laundries and dry cleaners which work in conjunction with collection and distribution centers whereby customers deposit articles to be processed at a time when the processing establishment or collection and distribution center is closed and no attendant is present. In these previous attempts to overcome establishment scheduling, the customer would place clothing in a laundry bag and leave the laundry bag in a predetermined unattended outdoor location or a drop chute attached to the establishment for the business operator pickup. This method has resulted in disputes between the business operator and the customer over the quantity and quality of clothing left in the laundry bag. Problems also continued regarding scheduling of deliveries of the clean clothing to the customers.

In addition to the problems of security and conflict between the customer and the operator regarding quality and quantity of laundry items contained in a specific delivered bag, billing and laundry instructions items have been traditionally handwritten. However, writing tickets by hand by the operator creates an environment for error because of memory lapses as to established base prices and up charges for various items and process instructions or errors in operator judgment as to item characteristics relevant to service prices. In a busy establishment, the pressure of time may promote even more errors. Depending upon the nature of the error, the customer or the operator may be dissatisfied with the frequency of errors where they are found in the services provided, information provided, and/or billing.

In addition to the laundry and dry cleaning industry, other industries require automatic item-driven systems for deposit and pick-up services in a job-driven environment. Remote vending services, library services, inventory control systems for automatic dispensing, and item rental services all share the need for automated information and inventory controlled systems.

The incorporation of computers in a point-of-sale terminal has been found to provide, for example, the mathematical functions for calculation of the total item prices or item service prices, taxes and informational bases regarding customer and services provided. The computerized point-of-sale terminals, while providing numerous advantages over handwritten tickets, does not remedy all of the problems associated with handwritten tickets and, of course, does not address unattended automatic deposit machines and the new additional issues raised by public use of such machines. In the dry cleaning and laundry industries, as in many other businesses, it is desirable to be able to account for all outstanding identification tickets and billings. As each ticket is returned, the returned ticket 1 5 must be reconciled against the record of outstanding tickets; however, frequently the consumer has forgotten to bring the ticket thus necessitating a human operator to manually audit and locate the laundry items.

To facilitate the accounting of outstanding tickets, the industry has in some cases turned to bar codes utilized on the tickets so that the bar codes can be scanned by an operator when tickets are presented. Each ticket bears a different bar code, either preprinted on the ticket form or manufactured at the time the ticket is issued. Reading of a ticket bar code at the time of incoming order and again at the time the outgoing items are returned to the customer permits enhancement of the normal functions of the point-of-sale terminal. However these operations have been utilized only at point-of-sale terminals, not successfully at remote location terminals, unmanned terminals or automatic deposit machine locations.

New and complex apparatus and processes have been developed for various industry uses, for example: devices and methodology for automatically invoicing and crediting the user of a system such as a medical diagnostic and therapeutic apparatus from a location remote from the system is found in U.S. Pat. No. 5,258,906 entitled "System For Remotely Authorizing operation Of A Device and For Automatically Generating An Invoice Based On Device Usage". Automatic vending machines having a bar code reader and bar coded columns and switches are presented in U.S. Pat. No. 5,272,321. In U.S. Pat. No. 5,025,140, apparatus is provided for receiving articles, storing the articles after processing and subsequently reissuing the articles. In yet another patent, U.S. Pat. No. 5,313,393, a system is provided for inventorying dispensed and deposited garments; the clean new or soiled garment is accessible to a user upon the user inserting a proper ID card and the card being validated.

A difficulty in operating these various deposit and dispensing operations whether sale of goods, rental of goods or services such as laundry or dry cleaning has been the need to be available 24 hours a day in multiple locations which better serve the public. Users of these services often wish to deposit and pick-up rental, dry cleaning or laundry items outside normal working hours and at a location which is more convenient to either the workplace or home. There remains a clear demand for an automated deposit and issuing machine system which also allows for pick-up and dispensing. However, despite this obvious need it is believed that no suitable machine or system is available which serves the public and yet provides security, access, information transmission, billing, payment and all other functions demanded and required by the user while still being user friendly. Of course, with service items, rental items, and special use items, it does not suffice to just dispense; it is important to require knowledge of the whereabouts of each item which has been dispensed for rental such as video cassettes or deposited for services such as laundry, dry cleaning and/or specific use of special equipment.

With the ever increasing demand on husband and wife working teams, it has become desirable to make video cassette rentals, library book usage, laundry and dry cleaning services easily available to the working public in readily accessible areas. At the present time, rental items, video cassette rentals, laundry and dry cleaning services are through established stores which maintain libraries, videos, laundry and dry cleaning equipment, thus requiring the leasing of considerable building space together with employment of personnel to manage the daily business affairs of these industries. More importantly, these businesses generally have established hours and are not open 24 hours a day. In addition, these stores are not always conveniently located or located within a convenient distance for the customer. To eliminate lease costs as well as personnel costs, it has been suggested that an alternative method of renting and acquiring services of items is by means of dispensing machines, especially dispensing machines for cash, videos and smaller items. The advantages of such machines are that they can be placed in areas of large public access such as shopping malls or apartment buildings and they do not require large floor space or attending personnel. These conveniences for the consuming public have not been provided, especially in the area of item services required by the public such as laundry and dry cleaning. Of particular importance with respect to the laundry and dry cleaning as well as video cassette rental and other dispensing and receiving systems, operations and reliability of the internal mechanisms as well as security and user friendliness of the system as a whole are needed. In this respect, it is important that such mechanisms or systems be completely reliable and provide depositories secure from vandals and the like since items such as video cassettes and garments to be dry cleaned or laundered can run into the hundreds even thousands of dollars per depository.

Suggestions to automate a previously manually operated rental, sales, or item service operation and systems to implement those suggestions have been found in various references addressing, for example, automated handling systems for coded bank deposit boxes and dispensing cash, automated machines for renting out car keys for rental cars, automated bowling shoe rental machines, and specific use items rental dispensing return and auditing. In each of these prior taught systems, problems continue regarding services, return and control features of the automated handling systems. These prior taught systems have not been applied commercially in noticeable numbers because of the various problems encountered by operators and customers attempting to use remote automatic dispensing and return systems. In the case of laundry and dry cleaning services, keys for customer access, security of the system, information, recordation of information and item inventory control are paramount and have not previously been provided.

The present Invention overcomes these and other problems and provides an automatic deposit and issuing machine for deposit of laundry and dry cleaning, required service information, special treatment of the laundry and dry cleaning followed by appropriate control and billing as well as payment, all through a remote automated system which has a logic that is an item-driven system and can also include personal identification logic systems. The automated deposit and issuing machine includes a compact, reliable deposit acceptance mechanism, storage mechanism which transfers bagged or bundled articles to be stored for laundry operator pick-up from the remote locations and a second storage system and dispensing system for processed laundry items for consumer pick-up at the automated deposit and issuing machine. In this respect, the present Invention provides a machine which serves as an interface between the customers and the required and requested process. The requested process could be as simple as storage but in this discussion is generally addressed as a laundry and dry cleaning remote automatic deposit and issuing machine. The automatic deposit and issuing machine can be used to make transactions such as prepayment for services to be received or items purchased. All of these possible uses show the broad use of the automatic deposit and issuing machine which can also serve the function of dispensing processed items, the machine having a storage arrangement and transfer arrangement which permits the storage of a large number of processed items within and which immediately dispenses such items upon proper access being exhibited by the customer.

Accordingly, several objects and benefits of the Invention presented in this disclosure are: (1) the business operator can efficiently provide a drop-off, pick-up and delivery service at remote locations where it is not necessary for the operator to be present to conduct transactions; (2) the business operator can provide the user of an automatic item-driven system for deposit and pick-up in a job-driven environment options including access, communication, conferring, instructions, security, storage, tracking, billing, payment and delivery; (3) the business operator provides automatic vending and dispensing at the operator's business or at a remote location unattended; (4) the present Invention also provides automatic systems which interface between job-driven environment services and the user; (5) the Invention can provide the operator with process and job planning information such as treatment of articles; and (6) work in process control that includes tracking, routing, processing, receiving, inventory control and distribution of articles. Accordingly, a need clearly exists for an automatic item-driven system for deposit and pick-up which is remote from the business operator and does not require operator presence while yet providing for security, information exchange inclusive of instructions, billings, payment methods and inventory control.

SUMMARY OF THE INVENTION

The present Invention provides a system including apparatus and method for automatically depositing/dispensing from the same apparatus and depositing of items as well as dispensing of items from apparatus) in remote, unmanned locations. For example, apparatus and methodology have been developed for receiving laundry and dry cleaning with customer information and processing instructions being receivable by a depository system. The automatic deposit machine (ADM) and the automatic deposit and issuing machine (ADIM) provide an interface between the customer and the cleaning processor. The ADM or ADM provide for secure and convenient use. Leaving clothing, dry cleaning or laundry at the cleaners could be very similar to making a deposit at an automatic teller machine (ATM). The ADM/ADIM (hereinafter ADM) could be attached to the cleaner's main facility or at a remote location at a distance from the main facility.

The ADM is capable of receiving dirty clothes as well as read input information about the clothes it receives. The ADM provides output after receiving items and input. In addition, the ADM will function in receiving bags, issuing bags, communicating, issuing claim tickets, printing laundry/dry cleaning lists, creating work-in-process files in memory, giving change and taking payments for services, and downloading/uploading data to and from a computer system or network or a radio frequency/integrated circuit tag means. The ADM can be accessed with each dropped bag of clothes after appropriate identification by one of several methods. The customer/user could enter a drop bag number if the code is illegible and his personal code via a keyboard, use a magnetic strip card, use a bar code, use a radio frequency identification tag, or other means. Currently the use of bar code on the outside or visible from the inside of the drop bag is one of several preferred methods. When the ADM provides proper identification and accepts the request for access, it will respond; however, if an invalid ID card, bar code, etc. is presented and read, there will be no response from the ADM with the exception of an invalid code message. In this operation, logic of the ADM diverges from the conventional ATM logic which is a personal identification system.

The operational logic of the ADM diverges from the conventional ATM logic. The ATM logic is a personal identification system that is more concerned about the security of the transactions and their posting than the process. The ATM logic is driven by the use of a personal debit card and the use of a security access, password/personal identification. Once the customer has gained access to the ATM, then he or she can instruct the ATM by making choices of transactions to be performed. The ADM logic, however, is an item-driven logic. When the item or container of items is presented, such as being laid in the cradle or loading position for deposit, the ADM scans for or reads an item or container identification that is recognized by the ADM. The acceptable positive identifiers are loaded in the memory of the ADM. The positive identifier can be in many forms: (1) handwritten notes on the item or container; (2) magnetic strip on the item or container; and (3) labels or cards attached having identifying information such as magnetic strip, bar code, microchip (smart card, RF/ID tags) and the like.

When the bar code system is utilized, the bar code has the identification for the container or item. In one case, the bar code would contain only the identification number and call for the data stored in the ADM computer memory for instructions peculiar to that bar code. In another case, the bar code has the identification and instructions imbedded in the bar code itself and instructs the ADM how to handle the items. Also a preference card with process instructions could be used in conjunction with a bar code to instruct the ADM.

A RF/ID microchip system will directly instruct the ADM as well as provide identification. Typically, a bar code or magnetic strip holds 9–100 bytes of read-only memory while an RF/ID tag can store 64 bytes to 8000 or more programmable bytes of read-write memory. The programmed microchip will be able to instruct the ADM to execute very involved, complicated tasks and store in process information like the batch number. Furthermore, the microchip will be able to go through the cleaning process and document data such as temperatures, time and other data and control the cleaning process. The ADM can program the read-write memory in the RF/ID tag with batch information for tracking and the date it was processed.

The ADM must be able to receive information as well as receive items. The scanner on board the ADM should be able to read the identifier code located on the drop bag. The ADM should be able to read a magnetic strip of a card inserted into a magnetic card reader on the ADM as well. Further, the ADM must be able to receive the identifier code even if the code was manually entered by a key pad means. The ADM must be able to read a printed form that has a bar code and convert the bar code to instructions. The ADM must also be able to receive information from a hand-held computer or a computer via modem.

The ADM must also be able to output information and instructions such as assigning bar code, print hard copy of a receipt with a bar code, send bar codes and inventory tracking data via modem or to a hand-held computer, output information and data to the RF/ID tags (microchips), provide a visual signal and display, and signals provide instructions of work in process batches to be used by cleaner's operator.

After scanning or reading the identifier, the ADM is instructed by the identifier to set the parameters of the work in process by receiving, identifying and tracking of the items and/or container of items. The customer has an option to modify these instructions if he or she wishes, but no choices have to be made by the customer in order to process the items. This Invention's logic is driven by an identifier code and instructions associated with a specific container or item, not a specific customer ID and clearance. The drop bag or container will have a code associated with it that will instruct the ADM to open and how to handle the items and container. The drop bag is used which has its own unique identifier code to facilitate the processing of items. The bar code or RF/ID tag on the drop bag can be used as an identifier as well as magnetic strip ID cards. The most important function of the ADM is the ability to receive instructions from a code associated with the item or container to be processed. The second important function is the identification of the items or container to be processed and its tracking.

The drop bag must originate from the cleaners or the ADM. The ADM can issue a drop bag at the remote location. The cleaners can issue a drop bag to a customer as well. The ADM will be able to receive the drop bag without modification or additional instructions. The ADM can issue a drop bag with an identifier code allowing a customer to "fast drop" the drop bag into the ADM apparatus. The ADM could print a hard copy claim ticket for the customer to take with him and use to claim his clothes on the date, time and location printed on the ticket. The ADM could also provide a standard list of contents without quantities and standing process orders. The cleaners will have to sort the clothes and provide the quantities. With modification and additional instructions, the ADM can issue a drop bag with an identifier code. The customer could fill out a laundry/dry cleaning list with process instructions. The customer could insert the form into the ADM, the ADM would read the list and display the data on a screen verification. The customer could insert written process instructions via a filled out form list or handwritten note into the drop bag. Once the ADM accepts the data, the door opens and the drop bag is deposited.

There may be more than one batch of items created from a single bag. Currently the cleaners' receiving personnel determine the number of the batches to be assigned for a group of dirty clothes left by each customer. This function could be accomplished by the ADM if the inventory of the contents of the drop bag is known.

The ADM serves as an interface between the customer and the requested process. The requested process can be as simple as storage. The customer wishes to access the machine to store items or to personally access the storage area to view the items in storage. This use would be more of a security function. The ADM could be used to make transactions such as prepayments for services to be received or purchased items. All of these possible uses show the broad use of this Invention. The unique idea is in the way the instructions for processing the items are received and dispensed.

An automatic deposit apparatus would be comprised of a casting defining a door, and a compartment having a frontal access opening and a rear discharge opening. The actuator-operated doors remain closed until a receptive activating signal is received and electrical means for supplying activating signals to actuate operated door locks and said door. There is a means for detecting and receiving, from a bar code or a transmitter attached or imbedded in the items to be deposited, a signal containing characteristic information about the items including but not limited to the physical attributes of the items, process instructions for the items, ownership of the items and the history of the items. There is an information reading unit receiving characteristic information by reading from a magnetic recording medium such as a computer disk or tape, laser disk medium, magnetic strip card medium attached to the items for sorting, symbols representing characteristic information indicating types of items to be deposited by the holder of the card medium, a response form medium for group code format having active locations on the form that are scanner responsive containing indicating symbols representing characteristic information, by scanning characteristic information from a bar code, by receiving signals from a microchip transponder attached to or imbedded in the items, by audio instructions, or by instructions from a computer via an interface method.

These and other objects and features of the present Invention will become more readily apparent from the description in which preferred and other embodiments of the Invention have been set forth in conjunction with accompanying drawings and appended claims.

BRIEF DESCRIPTION OF THE DRAWINGS

The present Invention will become more fully understood from the detailed description given herein below and the accompanying drawings which are given by way of illustration only, and thus, are not limitive of the present Invention and wherein:

FIGS. 9*a–b* is a flow chart for utilization with the ADM of FIG. 1 inclusive of display list processed standing orders and the like;

DETAILED DESCRIPTION OF THE INVENTION

Figure 1:
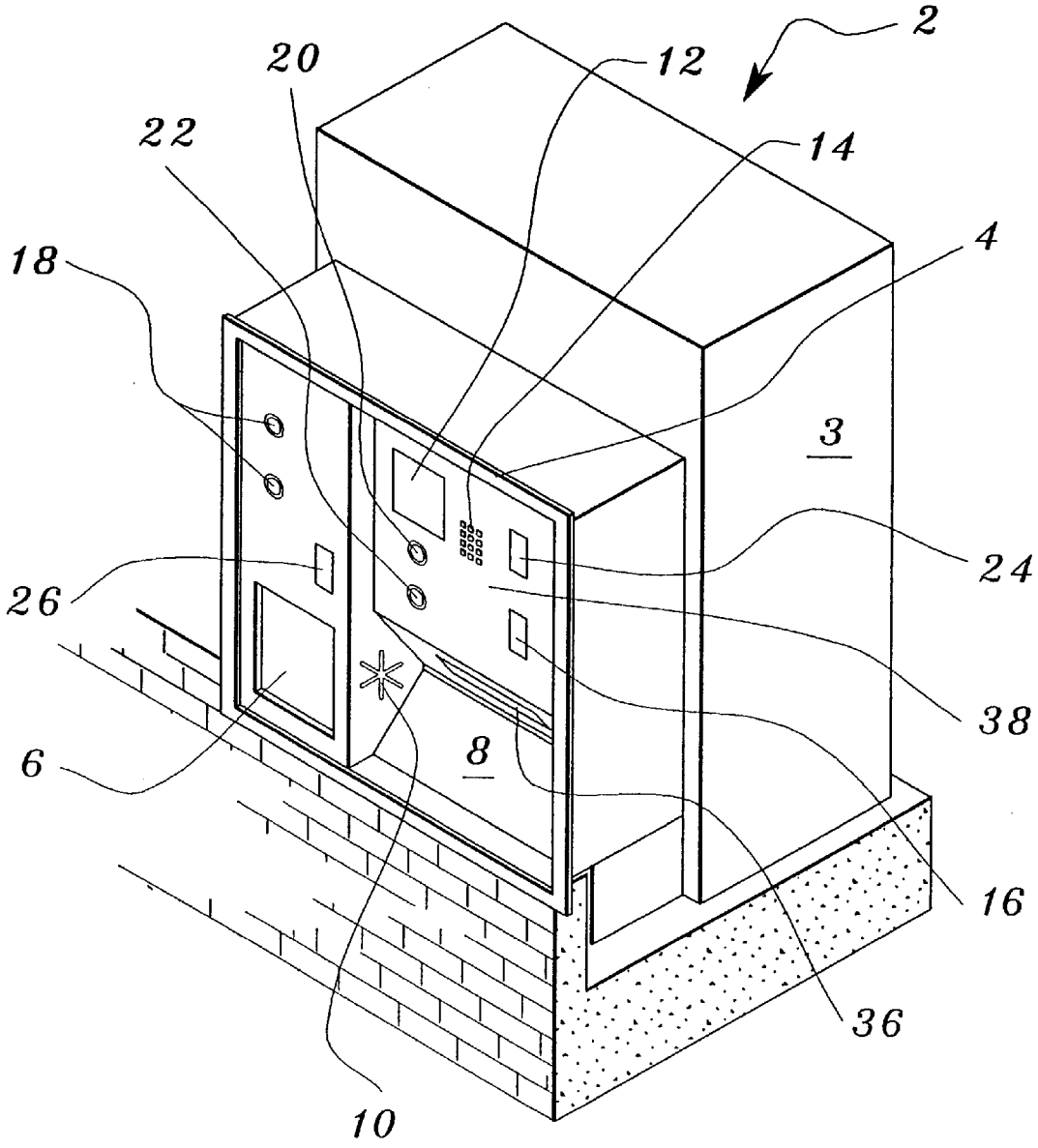
FIG. 1 is a schematic overall front view of a remote, full service automatic deposit machine (ADM) for the laundry and dry cleaning industry.

The following is an explanation of embodiments of the present Invention, based on the accompanying drawings wherein methods and apparatus of the automatic deposit machine (ADM) for depositing bags using various identification systems for the bags/items, providing a method of issuing process instructions and making further modifications of the services required at the remote ADM computer network. The ADM has a computer and memory with a monitor, keyboard, printer, card reader, scanning device/RF reader, speaker, bag dispenser and a bag insertion port and an article or item dispenser and coin and bill feeder. The ADM according to the Invention is responsive to the article, container or bag which gives an instruction unlike the ATM system that does not give instructions. In the simplest form, a bag which is purchased at the ADM will always have an identifier code associated with and located on or in the bag that also contains at least one instruction. The most basic instruction is open, which is only recognized by the ADM if received from the identifier code(s). The article identifier instructs the door to open or the door could also be opened by the use of a preference card associated with the bag giving the command to open. Such article identifier instructions are viewed as being article driven, item driven, or job driven. In summary, the initial instruction to open the ADM and begin the processing of the article/container resides in the identifier code itself. These initial instructions may be modified, added to, deleted by a variety of input devices to fully and more perfectly instruct the ADM for a particular job.

ADM methodologies suitable for providing instructions in a job driven environment include identifiers attached to the article inclusive of unique identifiers such as hand written notes, completed form(s), printed data, a number, magnetic strip, bar code or signal from a RF/ID tag. Preference cards associated or attached to the article are used as a separate card with the article are also suitable for instructions. Input devices used with the article or ID identifier attached to the article used with a preference card is another embodiment. Identifier attached to the article used with ADM memory as well as preference card used with ADM memory are also suitable. In addition, other embodiments include preference card used with input devices, identifiers used with input devices, ADM memory used with input devices, combinations of identifiers, preference card and input devices as well as all three including ADM memory or any other combinations. Input devices are those that are connected to the ADM other than the unique identifier or preference card. Examples would be a keyboard, touch screen, functional buttons and personal computer. Preference cards are customer cards that have personal preferences stored in the card's memory, bar code or magnetic strip that can be used when the card is read. The preferences are usually in the form of the command.

In FIG. 1, the ADM 2 is contained in a housing 3 having a chute 4 for receiving items for service, i.e., laundry or dry cleaning. A drop bag dispenser 6 is activated by a coin and/or bill feeder 26. The chute 4 includes a cradle 8, scanner 10 for achieving access to the ADM. A CRT is provided on the consumer or user activation surface along with instructional keys 14 and a receipt dispenser 16. Dry cleaning and laundry instruction buttons 18 are provided to edit fast drop instruction 20 or in the alternative when the more complicated instructions from instruction buttons 14 are required. The cancel button 22 cancels the ADM operation 22*a* and is for the consumer to avoid mistakes in inputting the appropriate information to the ADM 2. The coin and/or bill feeder slots 24 and 26 service the function of prepayment of laundry and dry cleaning through coin slots and bill feeder 24 and coin and bill feeders 26 for purchasing drop bags. The ADM 2 can readily be adapted to also provide dispensing of serviced laundry and dry cleaning through a companion remote housing and container which would follow various instructions utilizing very similar apparatus as in the ADM receiving machine or pick up of laundry and dry cleaning at remote locations again utilizing proper identification, instructions and responses.

Figure 2:
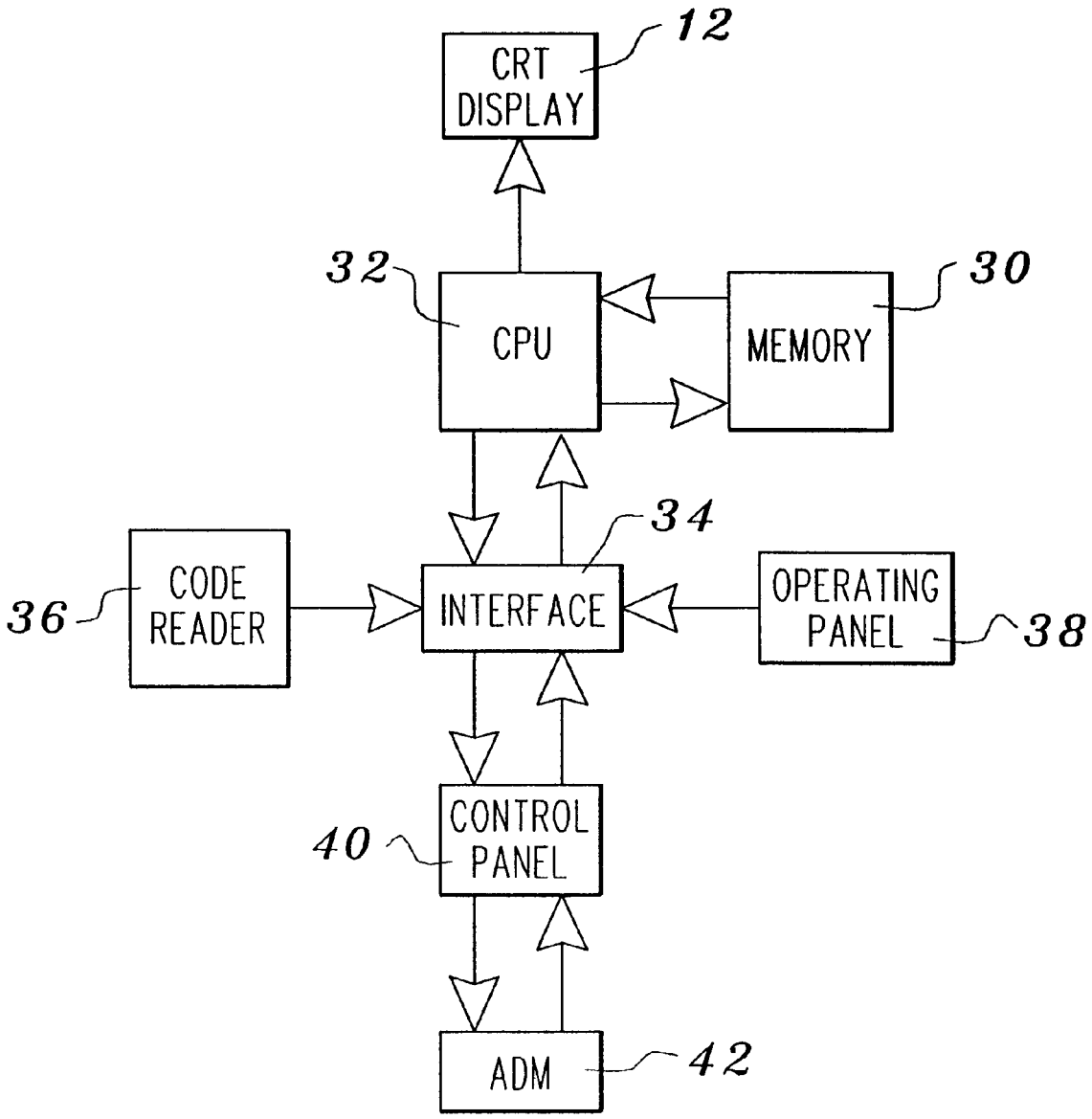
FIG. 2 is a block diagram of a control system for the ADM.
Figure 3A:
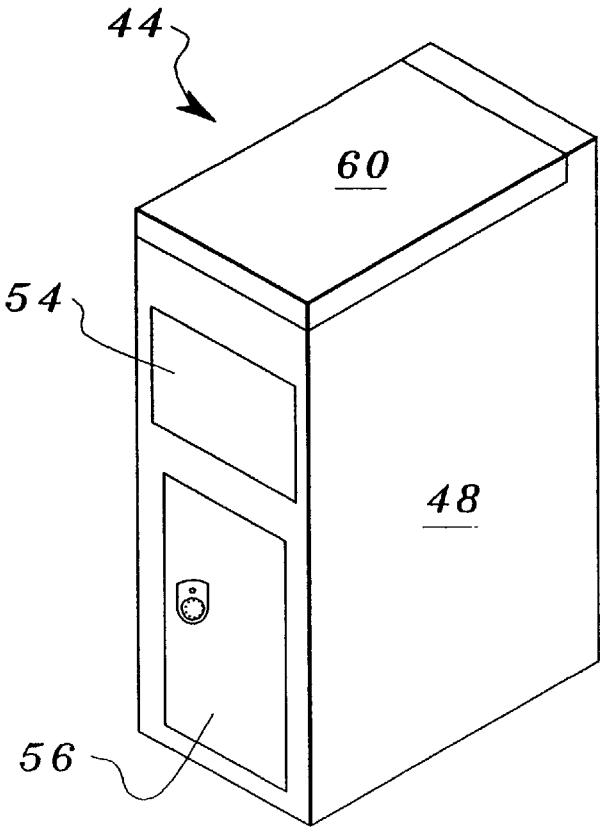
FIGS. 3*a–b* presents two perspective front views of simple form chutes.
Figure 3B:
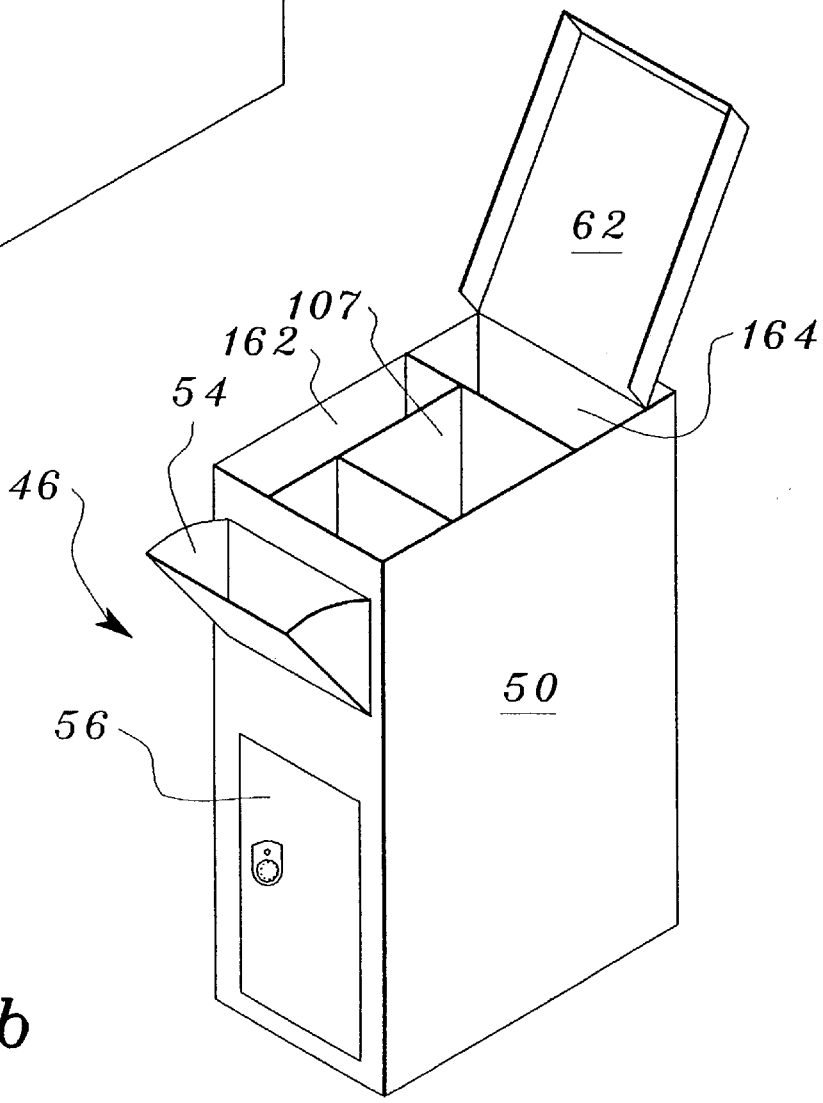

FIG. 2 presents one embodiment of a display device 12 (CRT: cathode ray tube) for indicating messages and a memory 30 such as a disk device for storing the identification code of each customer and various instructions regarding location of the laundry or dry cleaning services to be performed which is stored or connected to an arithmetic unit 32 having a push button switch or a digital switch and the like and a control panel 40 which controls the ADM 42. These various features are presented in FIG. 2 which is a block diagram of one control system suitable for use with the ADM 2.

The operation of the ADM of the present Invention is explained in various embodiments based on the flow charts shown in FIGS. 3–9. Further, in FIG. 3, simple form chute mechanisms 44 and 46 are presented. The simple form chute 44 has a housing 48 and the chute 46 has a housing 50. Forms and bags simple form chute 44 has a drop door 54 and a locked access door 56. Both simple form chutes utilize forms and bags dispensing mechanisms 60 and 62 respectively and provide a quick drop laundry and dry cleaning remote ADM.

Figure 4:
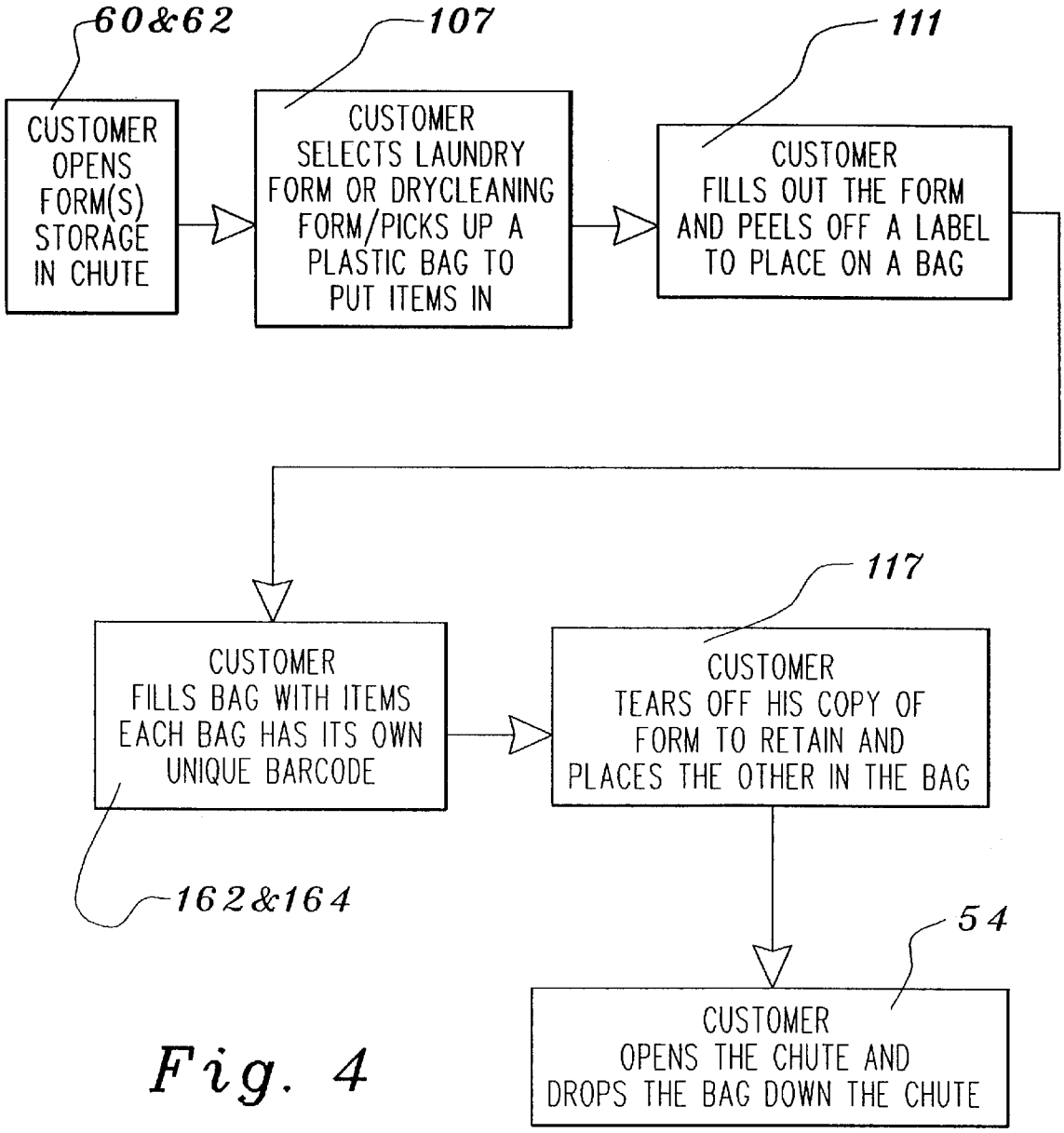
FIG. 4 is a flow chart for the simple form chutes.
Figure 5A:
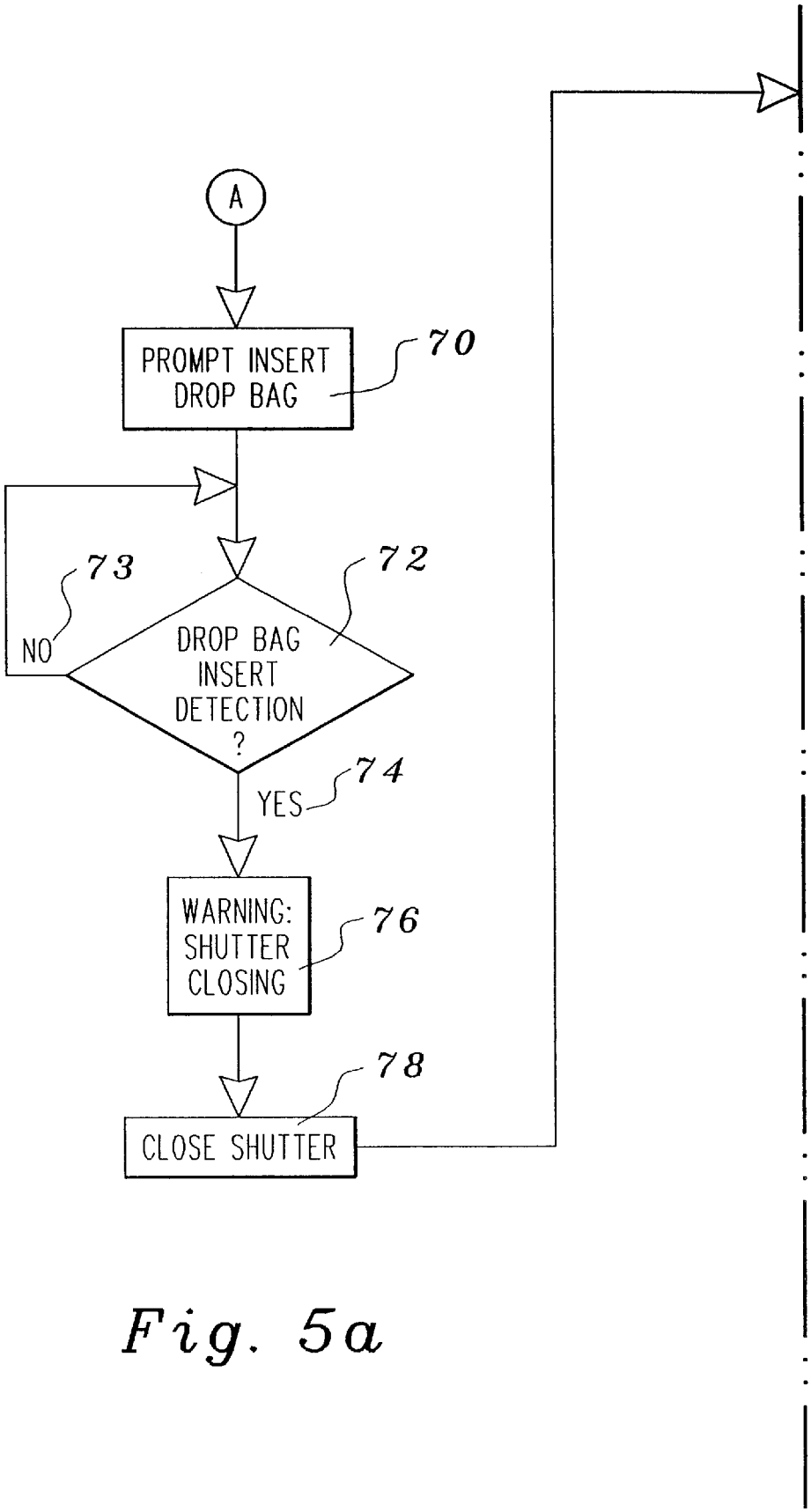
FIGS. 5*a–b* is a flow chart for the ADM of FIG. 1.
Figure 5B:
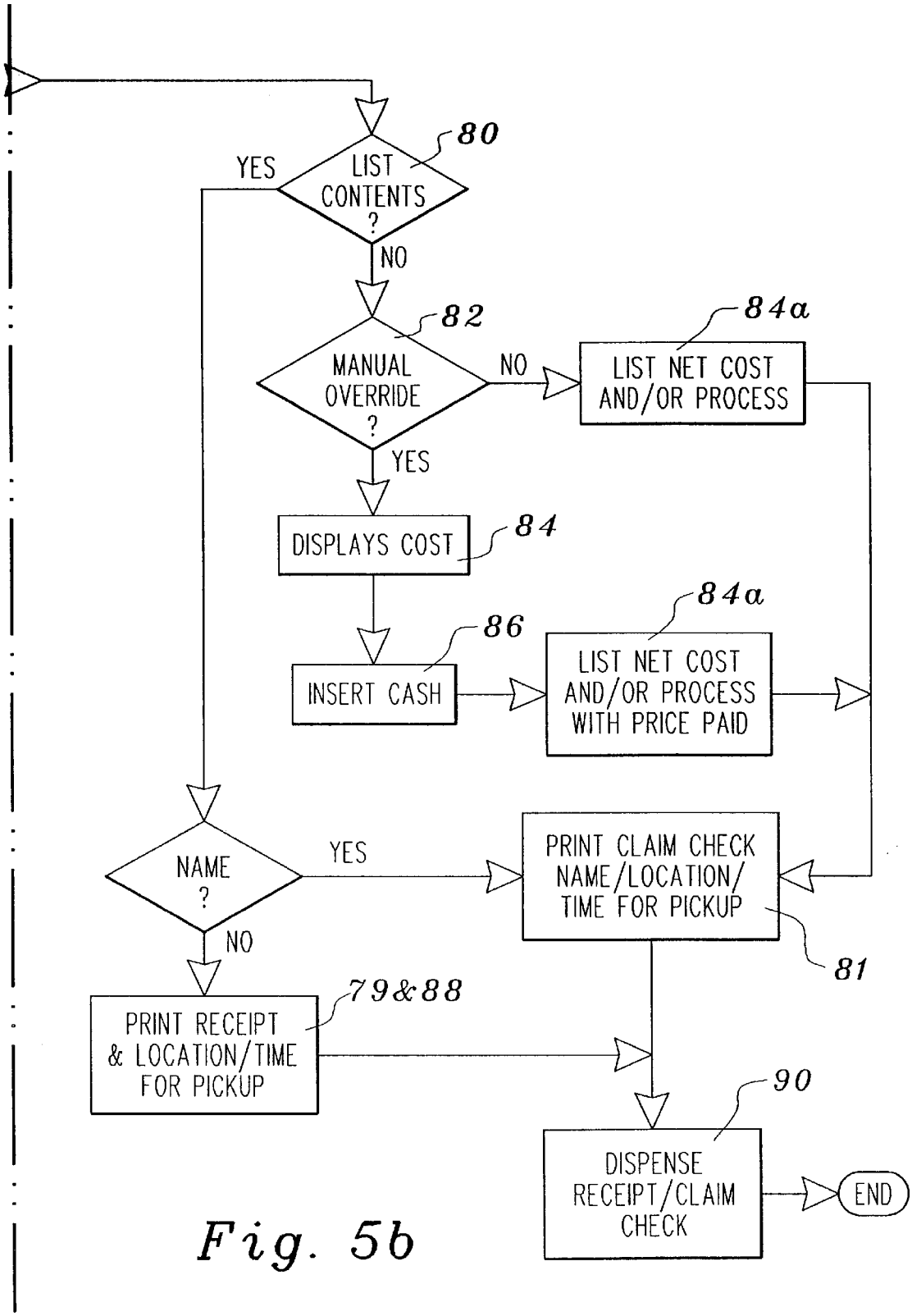

In the flow chart of FIG. 4 which illustrates the usage of an ADM system employing simple form chute mechanisms 44 and 46, a customer opens the forms and storage chute then selects laundry form or dry cleaning forms 107 and picks up a plastic bag or drop bag for containing soiled clothing both laundry 164 and dry cleaning 162. The customer fills out the form indicating the preferred process for the garments and peels off a label 111 to place in or on the drop bag so that each drop bag will have its own unique bar code and process instructions. The customer tears off his copy of the form to retain 117 and attaches the other to the bag. The customer then opens the chute 54 and drops the bag down the chute for later pick up through secure door 56 by the central laundry system. This embodiment illustrates the elementary form of depositing items with process instructions. In FIGS. 5*a–b,* another embodiment flow chart utilizing the ADM is presented. Customer makes a prompt insertion of the drop bag, 70, which goes through a screening for detection 72, and if rejected the bag is returned 73, or the door is not opened. If the drop bag is accepted 74, then the door mechanism has a warning shut or closing means, 76 followed by the door fully closing, 78. If the bag contains appropriate information such as name and customer identification and pre-recorded and stored laundry and dry cleaning preferences, the ADM prints a claim number, bag number, name, location, time for pick-up 81 and dispenses a receipt that can be used as a claim check, 90. If the information is not included, then customer can utilize the computer means, 82 and CRT screen which displays cost, 84 and allows the customer to override printed list and/or process information 84*a* which along with insertion of coins, bills, or stored value card 86 indicates the process required along with price paid which then goes through the ADM computer system and prints a claim number, name, location, time for pick-up, 88 and dispenses a receipt claim check, 90.

Figure 6A:
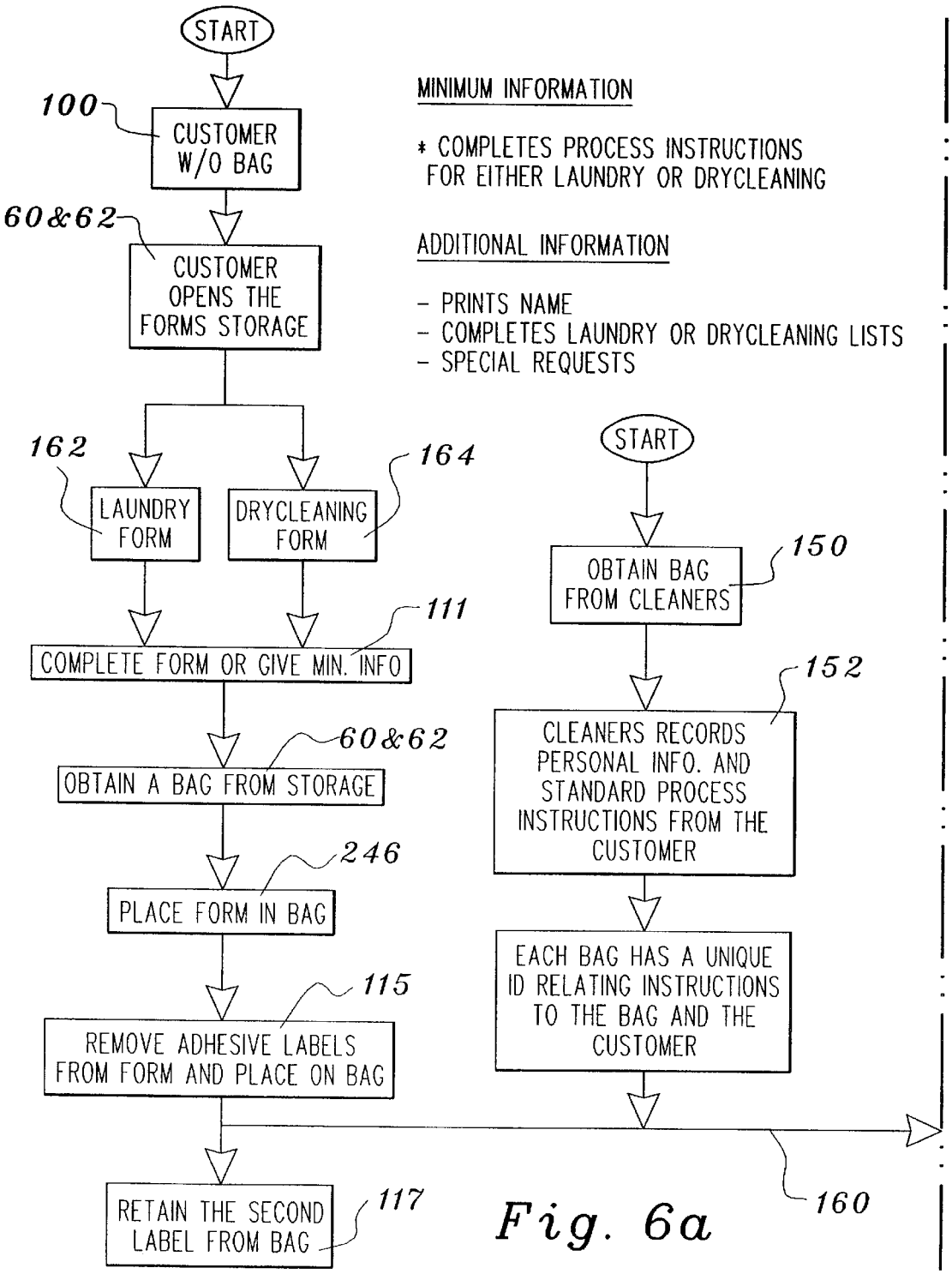
FIG. 6*a–b* is a flow chart for the ADM apparatus of FIG. 1 inclusive of a customer without a bag or a customer who obtained a bag from the central cleaning location.
Figure 6B:
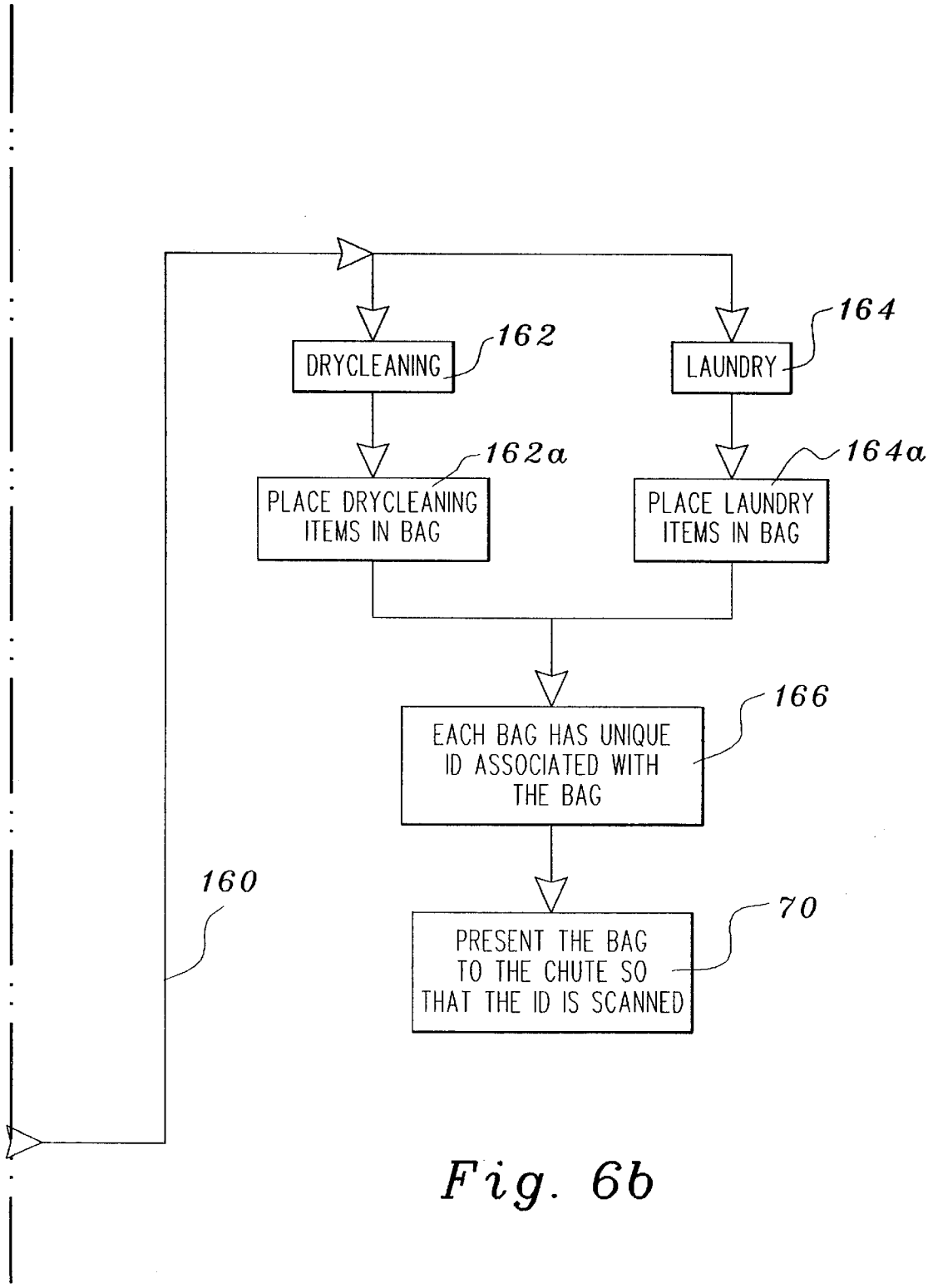

The flow chart for utilization of the ADM according to FIG. 6 shows the function of the ADM remote system wherein the customer is without a bag, 100 or has obtained a bag from a retail or central store location or from the machine itself. The customer opens the form storage compartment, 60, 62 and utilizes the laundry, 162 or dry cleaning form, 109 or both edited with appropriate information services requested, 111 and the like and obtains a bag from storage 113. On the other hand, if the customer has previously obtained a bag with a unique identifier, 150 the cleaners may have on record various personal information, and edited standard process instructions from the customer 152. In the case where the bag is acquired from the ADM, removal of adhesive label comprising in part a unique identifier such as an RF/ID tag or bar code from the form and one portion being placed on the bag, 115 with the customer retaining the second label, 117 from the bag for retrieval and record purposes, the two systems then merge, 160 either going to dry cleaning 162 or laundry 164 sorted by the customer 162*a,* 164*a.* Each bag having a unique identifier 166 and the bag is presented to the chute with the ID positioned for reading or scanning and recording of information by the ADM system, 70.

Figure 7A:
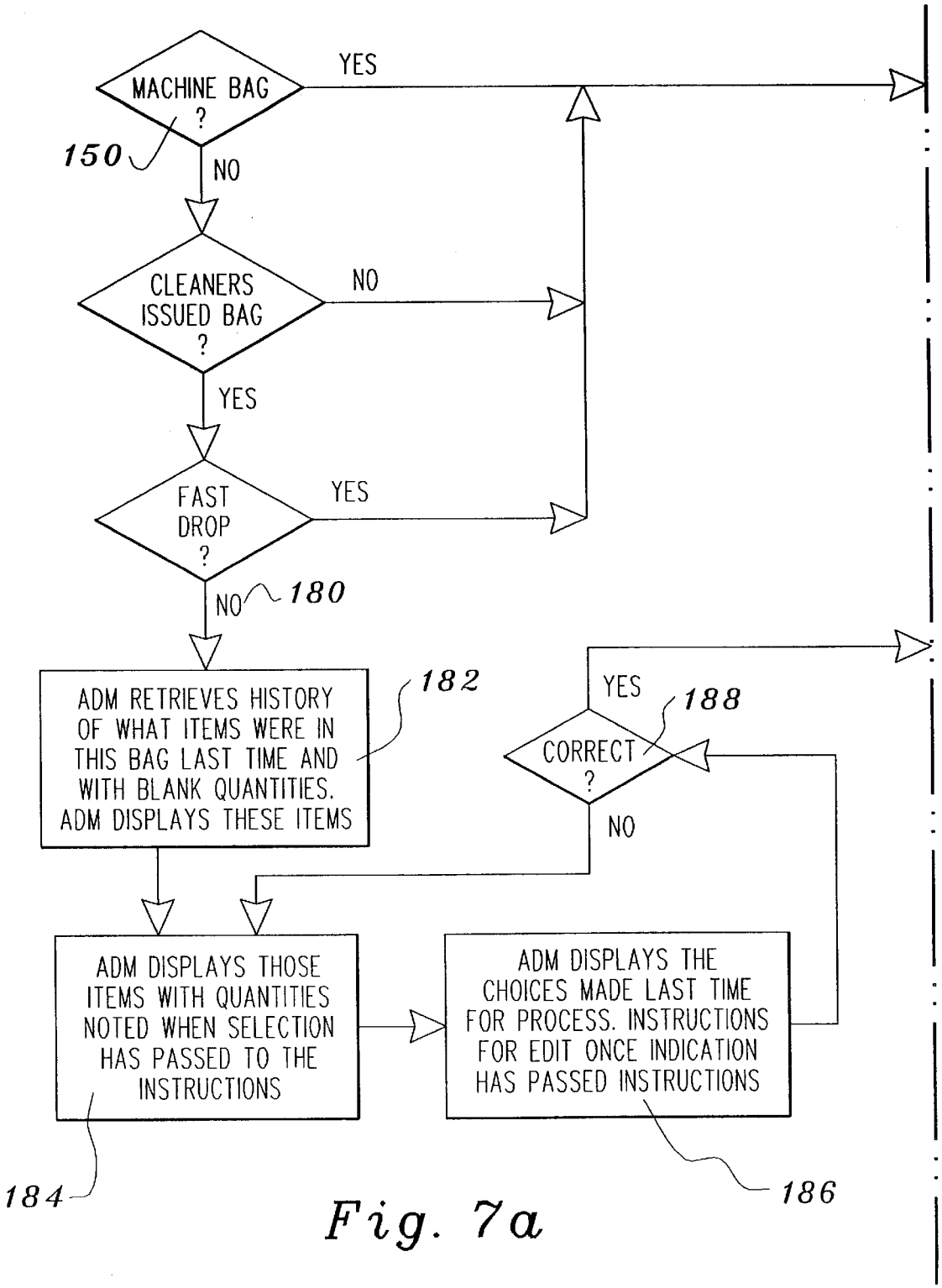
FIGS. 7*a–b* is a flow chart utilizing the ADM of FIG. 1 and a expanded ADM database recognition and programming of the customer provided information.
Figure 7B:
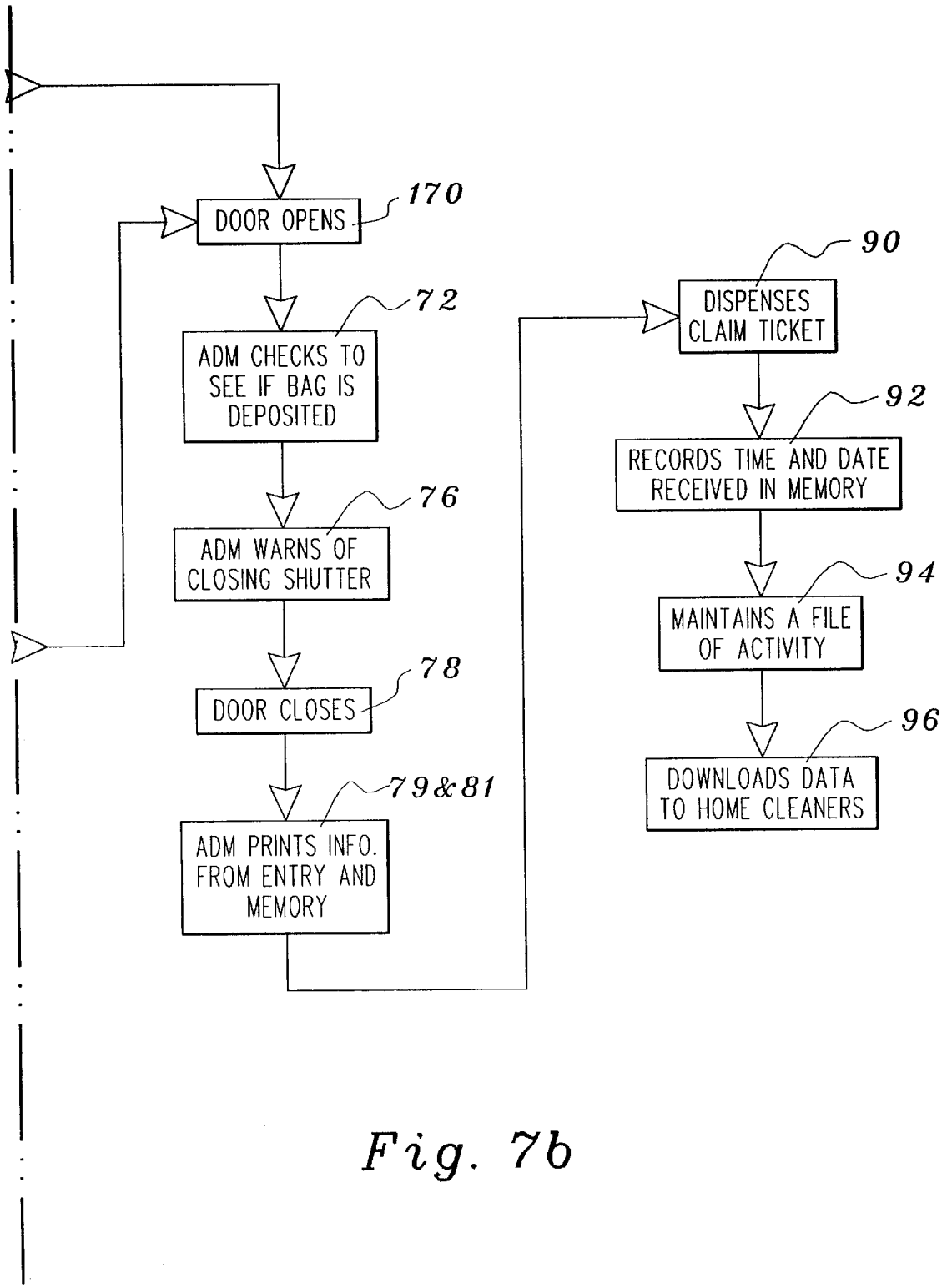

In yet another embodiment, the flow chart of FIGS. 7*a–b* provides three various approaches and utilization of the ADM, that is, a machine or ADM dispensed bag, a cleaner's issued bag or a fast drop bag, all three which can be accommodated by the ADM. Once the ADM machine, 2 issues a bag 150 from a dispenser module door 6, then the shutter or door 8 is open, 170 upon appropriate identification or reading or scanning of the bag and the ADM checks to see if the bag is deposited, 72 followed by a warning of closing shutter 76, shutter and door closure, 78 and ADM printing of information from entry and memory, 81 followed by dispensing a claim ticket, 90. The records, transaction number, bag number, time, and date of receipt are held in memory by the ADM 92 which, through the software and files integral to the ADM computer, maintains an active file during the process and monitors position of the customer's goods, 94. The ADM downloads data to the home cleaner's operations for services, 96.

The fast drop operation allows the foregoing procedures to take place; however, if the fast drop is denied, 180, the ADM retrieves history of what items were in the bag last time and displays those items, 182 with blank quantities with the ADM displaying choice items to be activated by keyboard by the customer. The ADM displays these items with quantities noted when selections have been passed on by instruction means, 184. The ADM displays the choices made and the previous process instructions for those items are also displayed for confirmation or editing, 186. When customer confirms all choices and instructions 188, then the shutter or door mechanisms open, 170 allowing the ADM to receive the bag under the same procedures as discussed under fast drop.

Figure 8A:
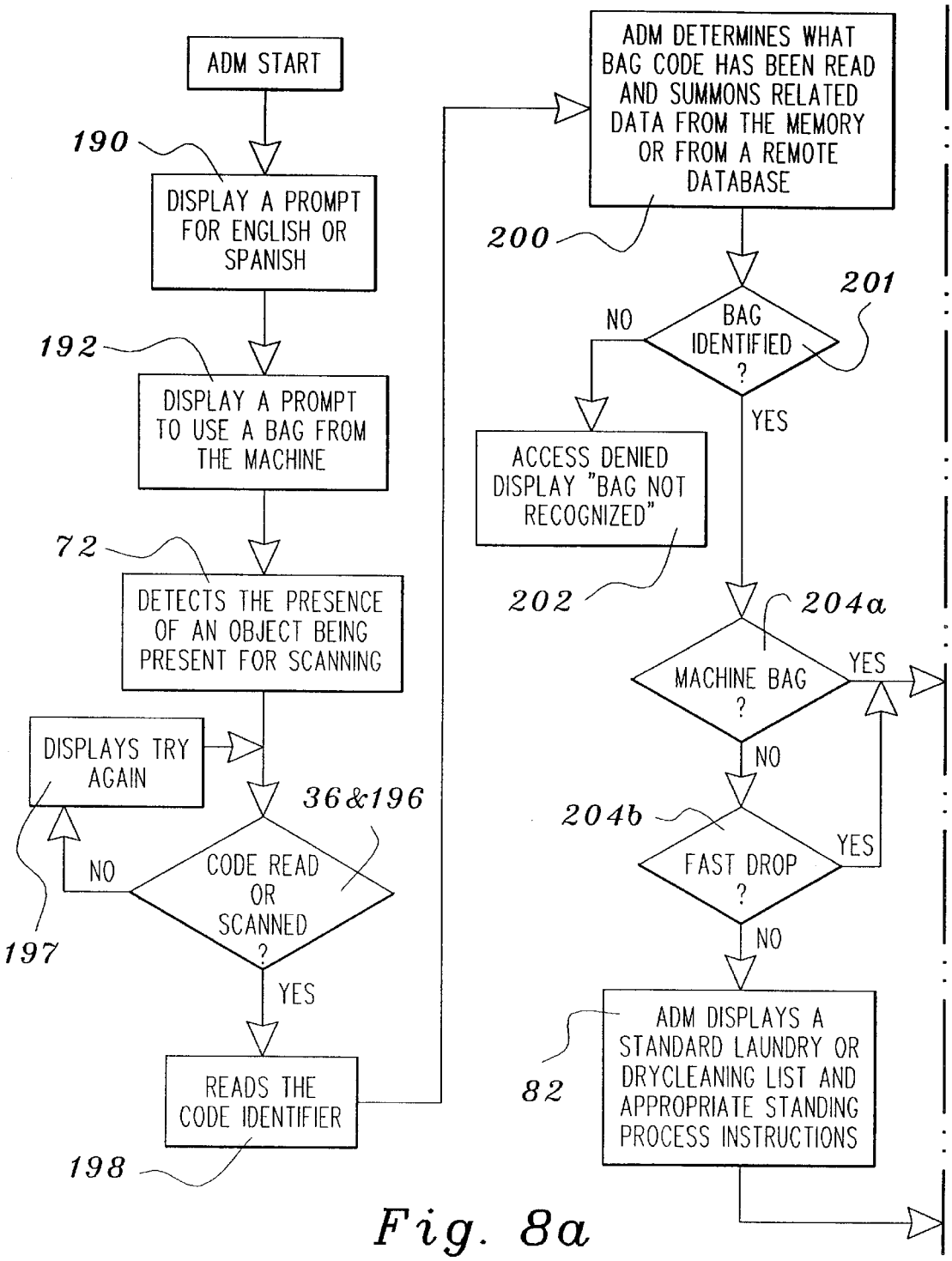
FIGS. 8*a–b* is yet another flow chart utilizing the ADM of FIG. 1 which allows further customer input into the ADM system and ADM displays to the customer.
Figure 8B:
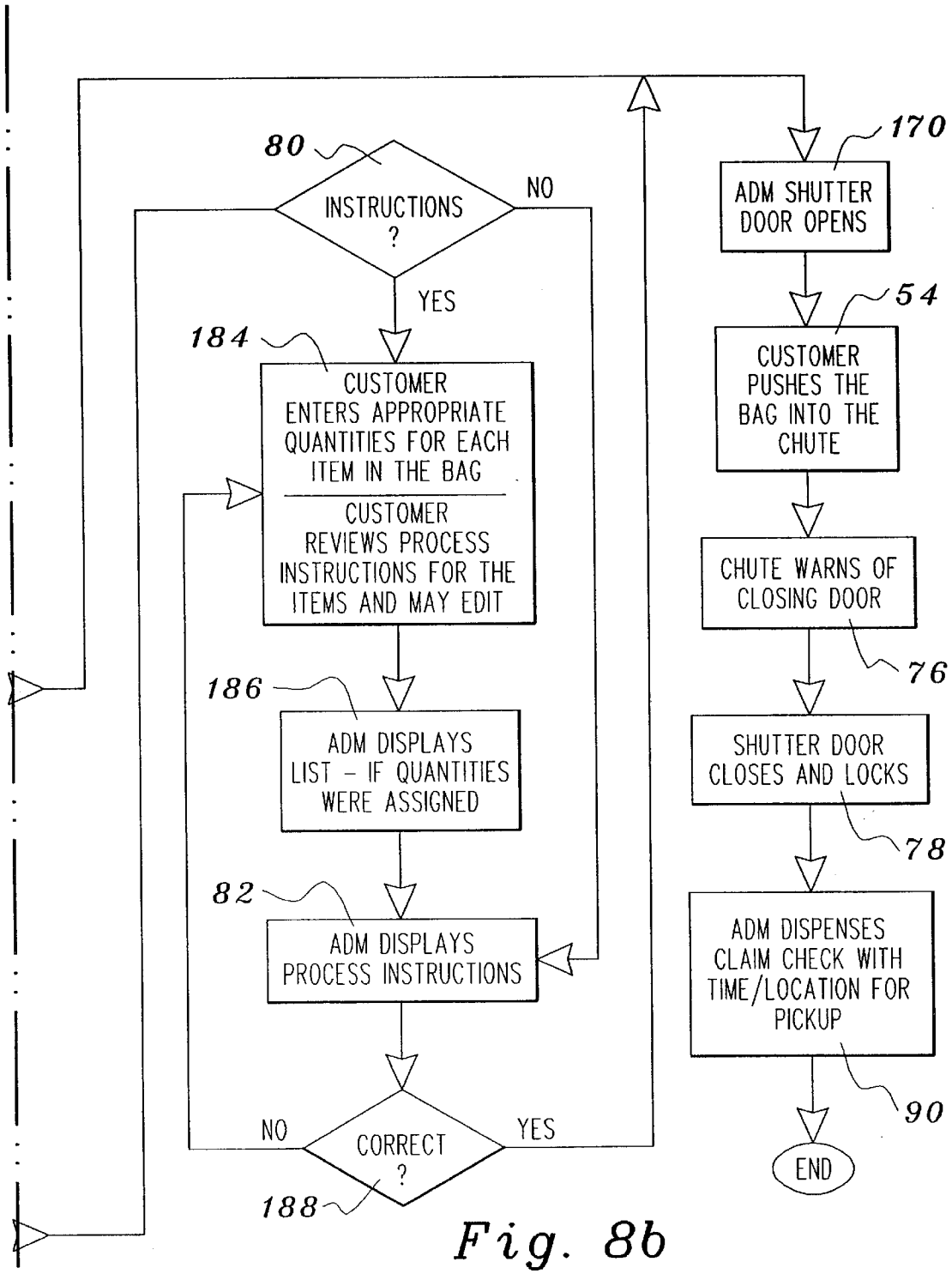

In FIGS. 8*a–b,* the ADM is utilized according to the flow chart which includes bilingual displays, 190. The ADM displays a prompt to use a bag 192 from the dispenser module 5 attached to the machine, 2 and detects the presence of an object being present for scanning, 72. Once appropriately read 36 or scanned 10, 196, then the ADM reads the bar code or RF/ID tag, 198 identifier for further processing. However, in the absence of visual or auditory confirmation of the identifier being correctly read or scanned, then the display indicates that the customer should try again, 197. In the case where the bar code or RF/ID tag identifier is appropriate, the ADM determines what bag code has been read and summons related data from the memory or from a remote database, 200, followed by bag identification for access 201. If the bag is not recognized, then the display may so indicate and the bag will not be received, 202. Either drop bag, 204*a* or fast drop bag, 204*b* if approved will proceed forward to ADM shutter door opening, 170 with a customer pushing the bag into the chute, 54 and the chute warning of the door closing, 76. The shutter door closes and locks, 78 and the ADM dispenses a claim check with bag number, transaction number, time, location for pick-up, 90. In the case that the fast drop or drop bag is denied, the ADM displays a standard laundry or dry cleaning list and appropriate standing process instructions, 82. These instructions, 80 may be utilized by the customer by overriding the appropriate quantities for each item in the bag with the customer reviewing the process instructions for the item and may or may not edit same, 188.

Figure 9A:
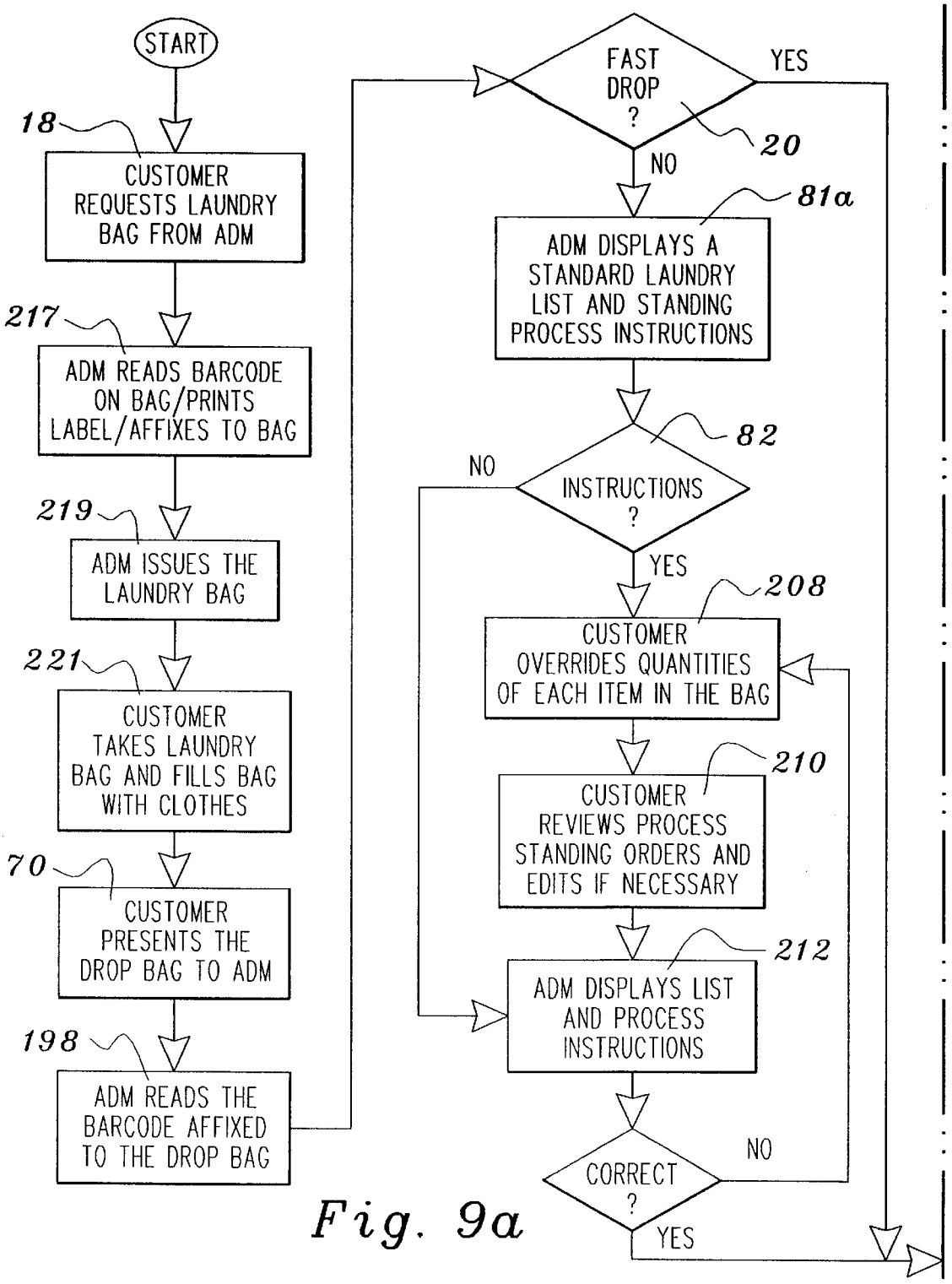
Figure 9B:
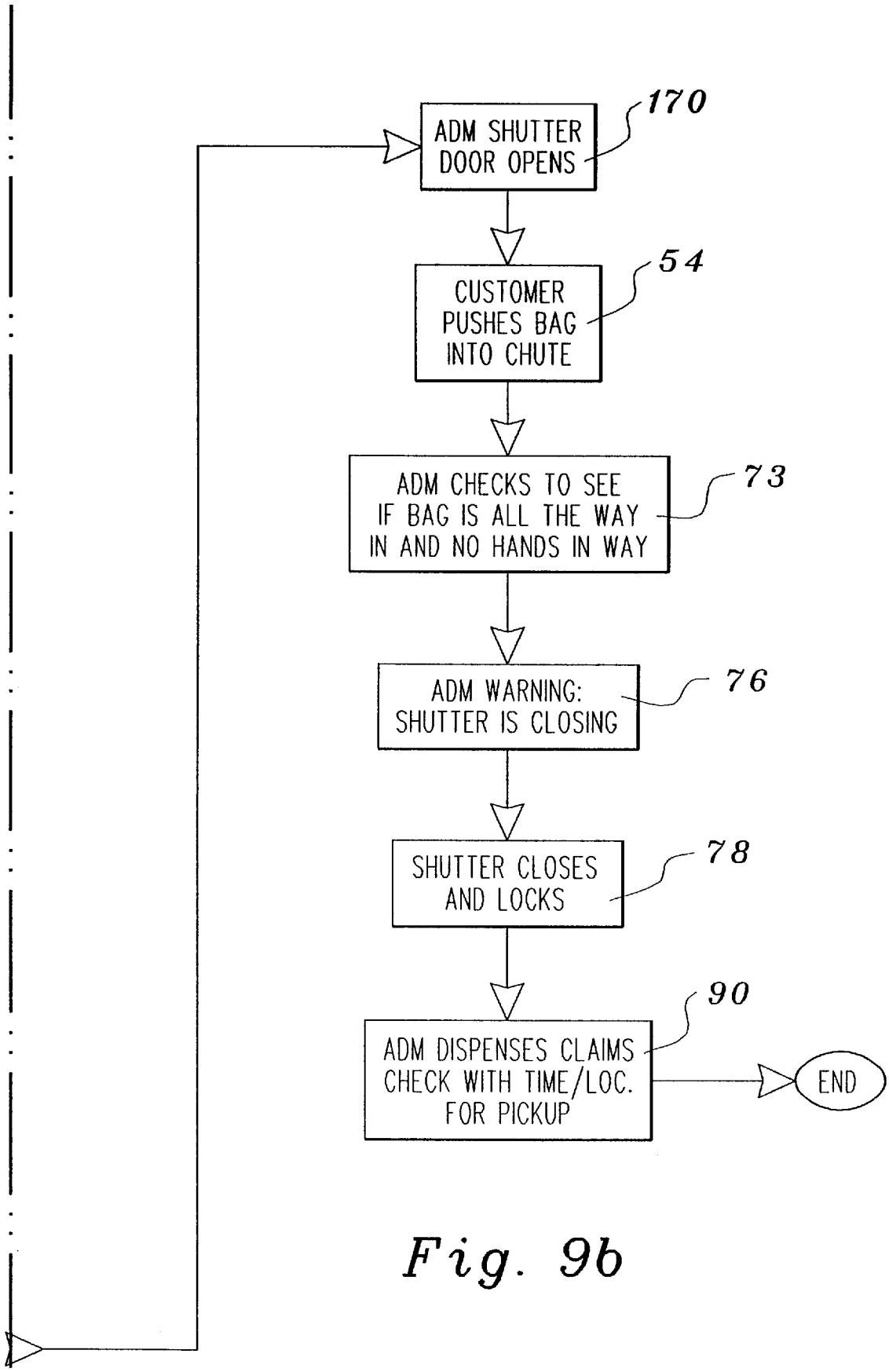

Another ADM use chart is presented in FIGS. 9*a–b* when the customer starts by requesting a laundry bag 18 from the dispenser modules attached to the ADM 2, 215 or that the ADM designate that the bag is a laundry bag and that it has a unique number. The ADM reads bar code RP/ID Code or bag/print labels affixed to the bag, 217. The ADM issues the laundry bag, 219 and the customer takes the laundry bag and fills the bag with soiled clothing, 221. The customer then presents the drop bag to the ADM, 70 with the ADM which employs an electro-mechanically oriented scanning means such as the Model MS 860 scanner produced by Metrologic, reading bar code affixed to the drop bag, 198 and can go through fast drop route which immediately moves to the ADM shutter door opening, 170 through scanner means with the customer pushing the bag into the chute, 54 and the ADM checking to see if the bag is properly inserted and that no hands or other obstacles are in the way of the shutter closing, 73. The ADM warns that the shutter is closing, 76 followed by shutter closure and lock, 78. The ADM dispenses the claim check with transaction number, bag number, time, location for pick-up, 90. If the fast drop route is not utilized, then from the ADM reading the bar code and/or RF/ID tag affixed to the bag the ADM displays a standard laundry list and standing process instructions, 81*a* allowing editing by the customer, 82 which the customer overrides quantities of each item in the bag such as shirts, jeans, white shirts, towels and the like, 208. The customer reviews the process standing orders such as heavy starch, medium starch, hanger, fold, and edits if necessary, 210. The edited list and process instructions is displayed to the customer 212 before passing on to the procedure of the ADM shutter door opening, safety warning closing and the like.

Figure 10A:
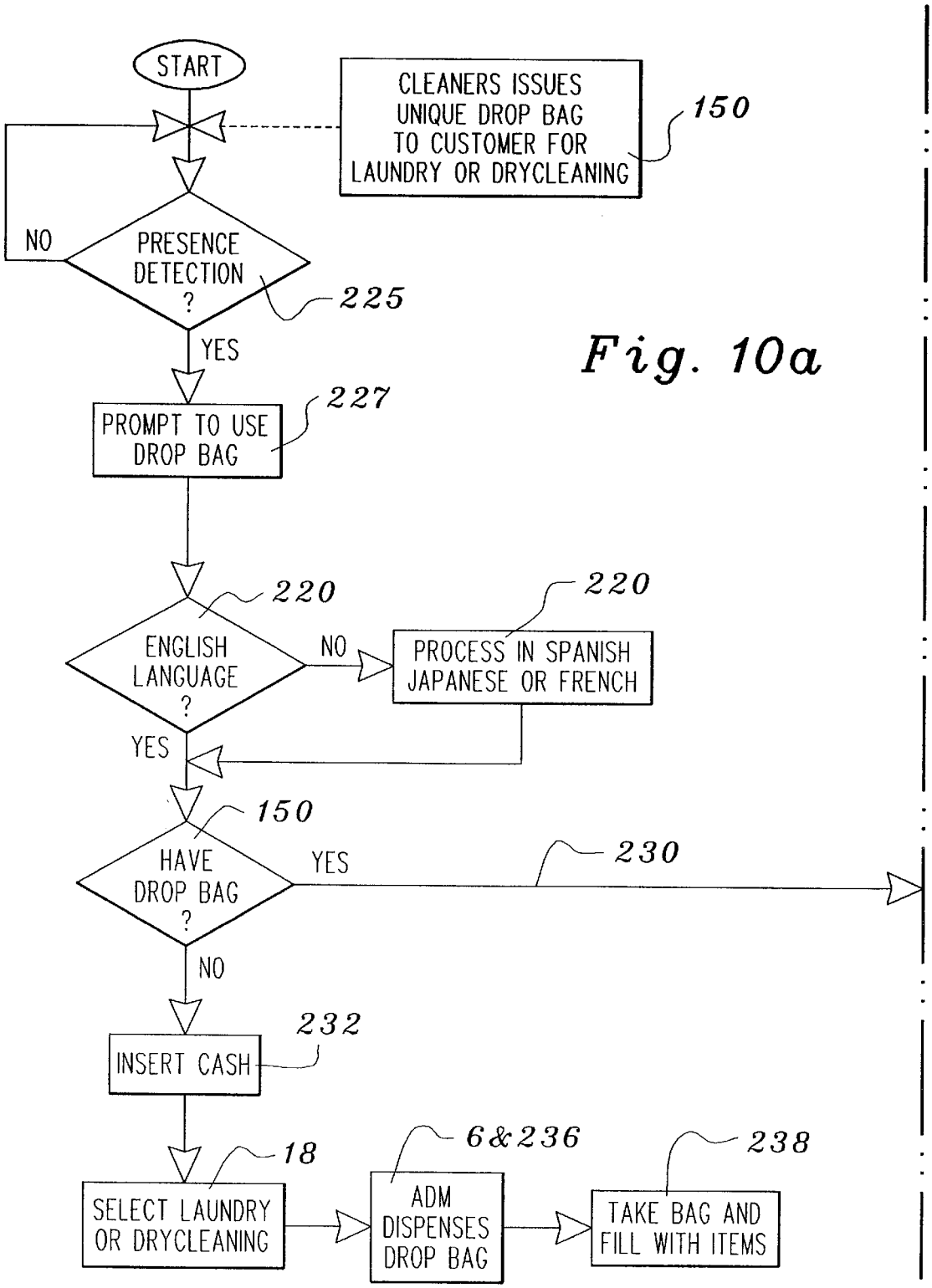
FIGS. 10*a–c* is a flow chart of the ADM of FIG. 1 showing further refinements utilizing bar code utilization.
Figure 10B:
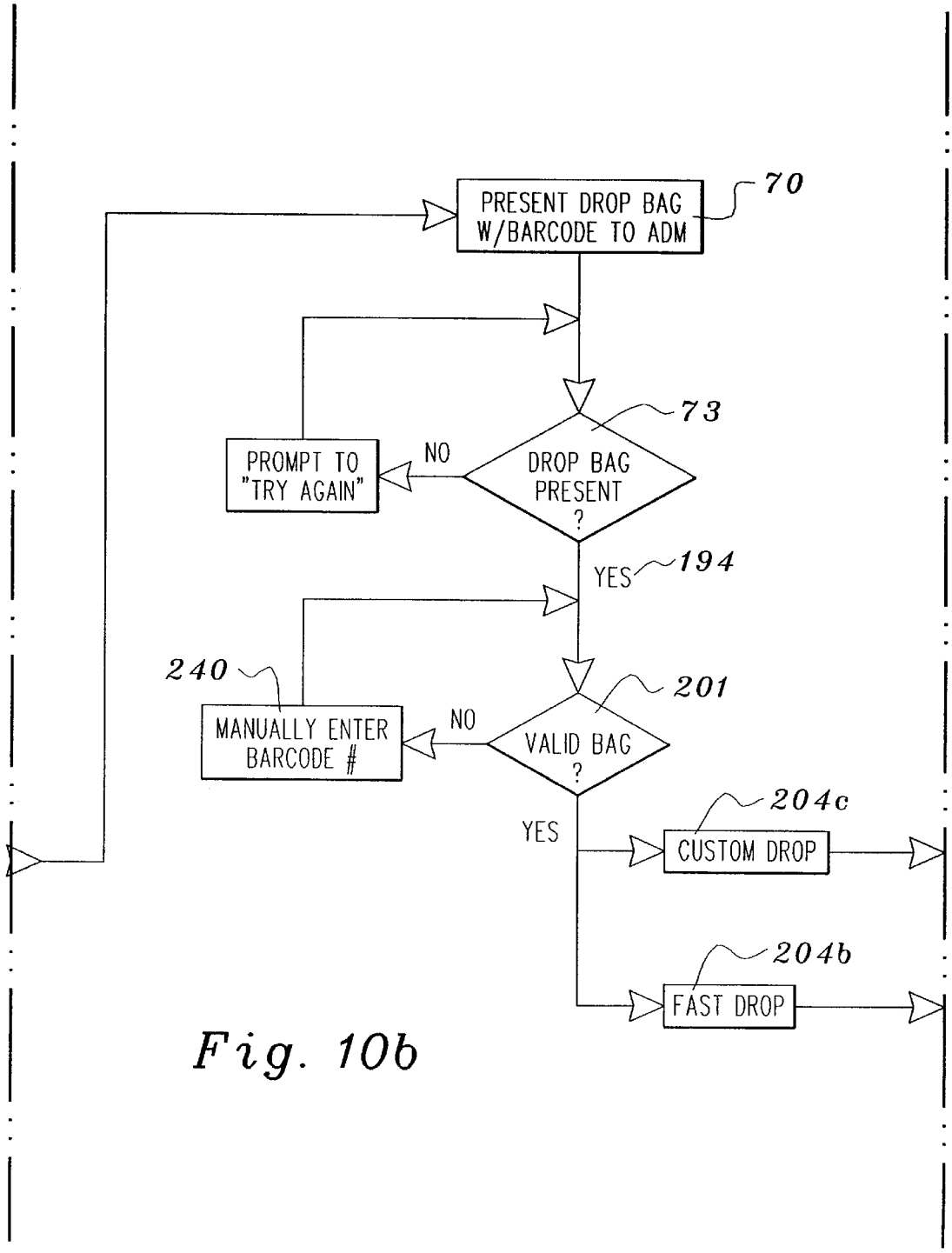
Figure 10C:
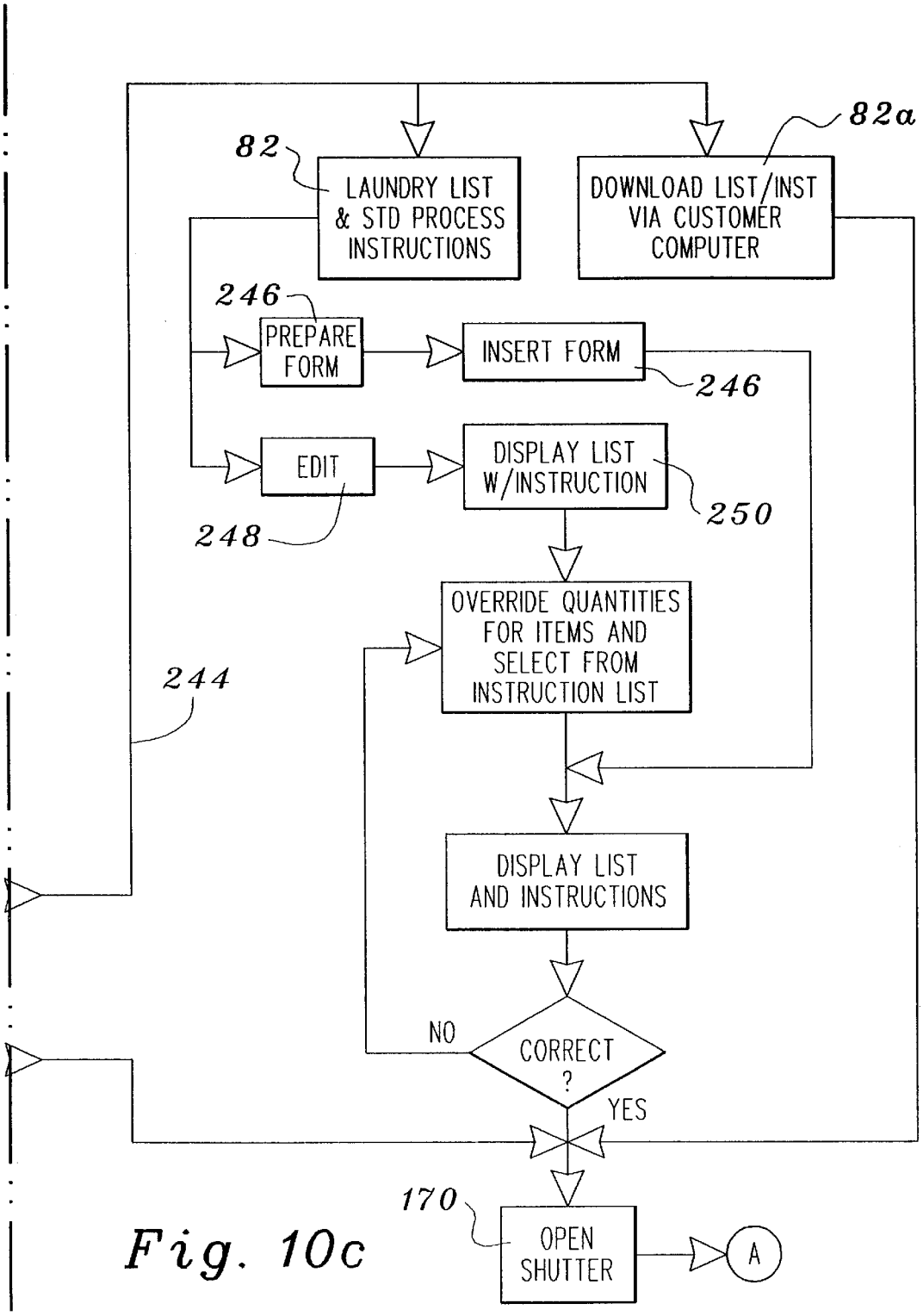

The ADM utilization flow chart in accordance with FIGS. 10*a–c* also provides multiple language feedback and instruction as the customer's presence being detected, 225 and/or the customer using a drop bag acquired from a retail store or the laundry and dry cleaning establishment, 150. The presence detection prompts the customer to use the drop bag, 227 with various language modifications, 220 and if the customer has a drop bag, 230, proceeds with the normal identifier ADM reading, 56. However, in the case of no drop bag, the customer may be required to insert coins, bills, or stored value card for payment 232 selecting laundry or dry cleaning bags, 18 from the dispensing module attached to the ADM 5 dispensing drop bags, 236 which are then filled with appropriate soiled clothing, i.e., laundry or dry cleaning, 238. Once the bag is presented with the identifier to the ADM, ADM acknowledges that a drop bag is present, 194, proceeds to validate the bag and proceeds further, 201. However, in the absence of visual or auditory confirmation that the drop bag presented is for some reason not identified by the ADM then the customer is prompted to try again. In some cases, the customer may have to manually enter a bar code number, 240 if the bar code is inadvertently misaligned or mispresented to the scanner reader. Once the identifications of the bags are completed by the ADM two pathways are available, the first being a fast drop route, 204*b* and the second being a custom drop route, 204*c*. The fast drop route proceeds to the open shutter mechanisms, 170 as discussed in the proceeding flow charts and FIGS. 3–8. The custom drop route, 244 allows editing of laundry list and standard process instructions, 82. Further, the customer may edit list and instructions by downloading from a customer computer, 82*a*. In those cases, the process of the ADM proceeds to the open shutter step, 170. In the case of the custom drop route 244, laundry list and standard process instructions, 82, may be edited by inserting a form into the package, 246 or editing of the information on the database can be achieved through computer instructions, 248 with the quantity of items being filled in and selected from an instruction list and either system proceeding through the ADM so that the ADM displays back to the customer the list of items and instructions for review and correction, 250. If satisfied, the customer proceeds with the process which involves the beginning steps of opening the shutter, 170 and deposition of bags, A.

Figure 11A:
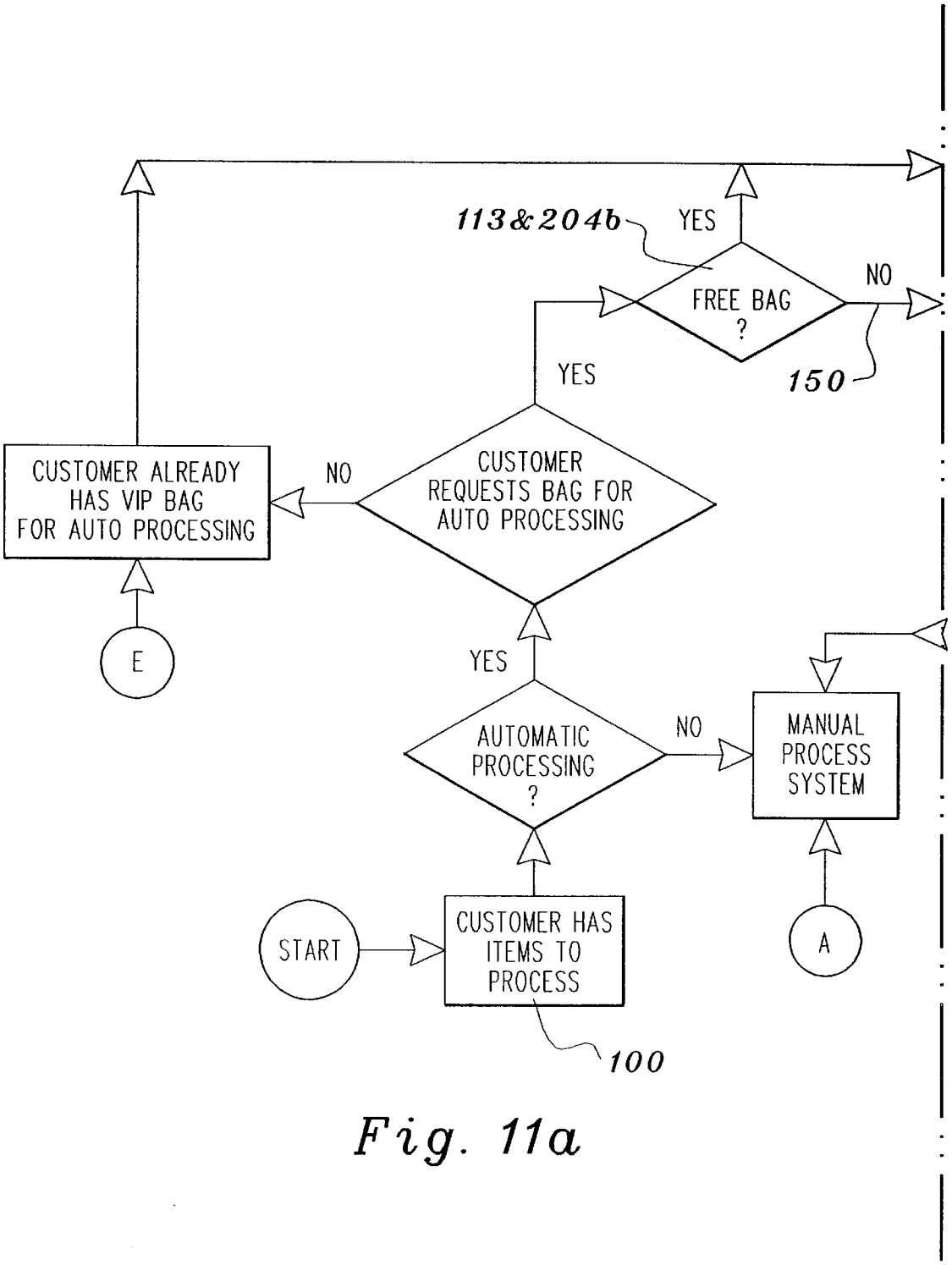
FIGS. 11*a–r* are flowsheets of the operations for automatically depositing/disbursing of laundry and dry cleaning including remote locations, central finishing, receiving and distribution utilizing ADM having logic which is an item/job-driven system.
Figure 11B:
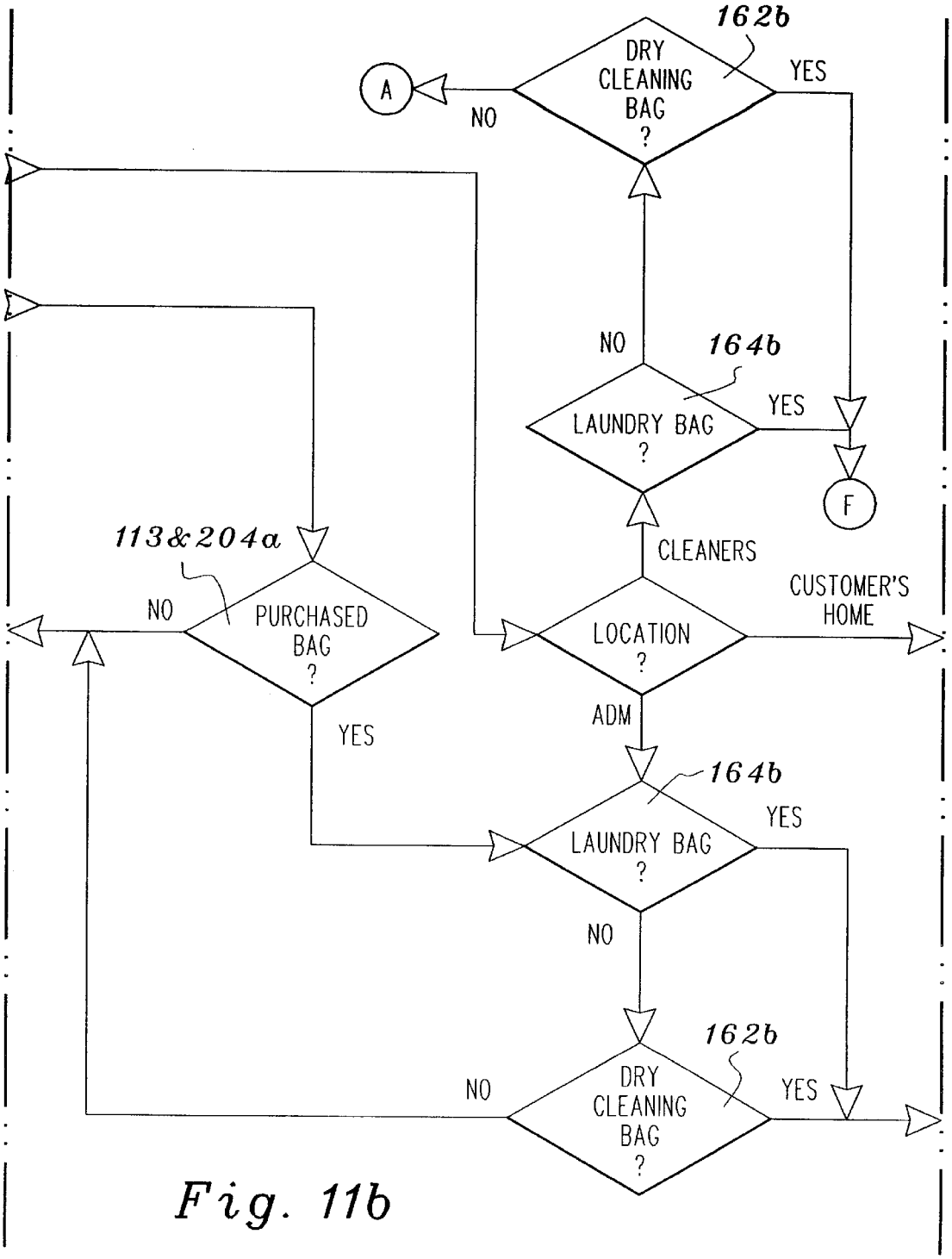
Figure 11C:
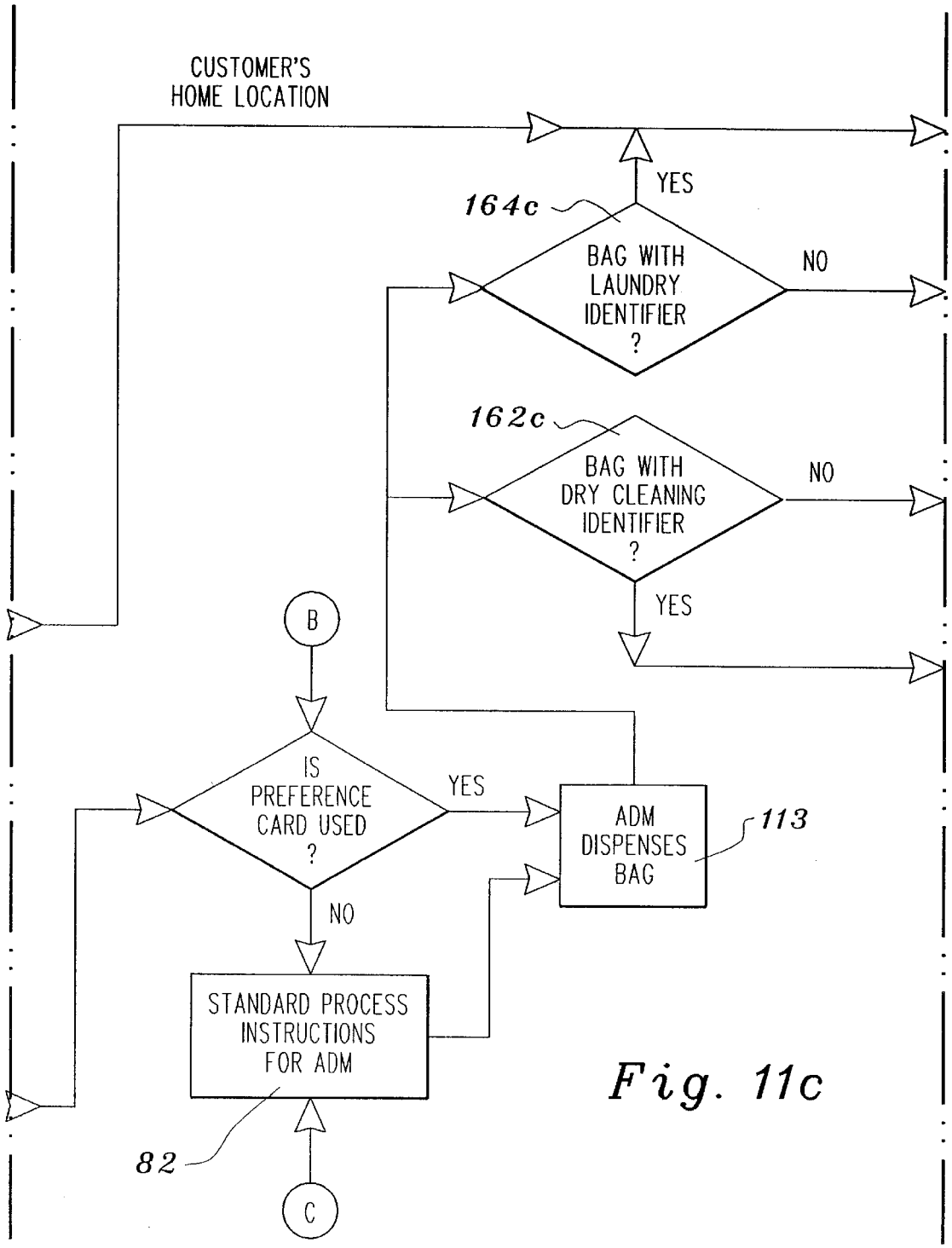
Figure 11D:
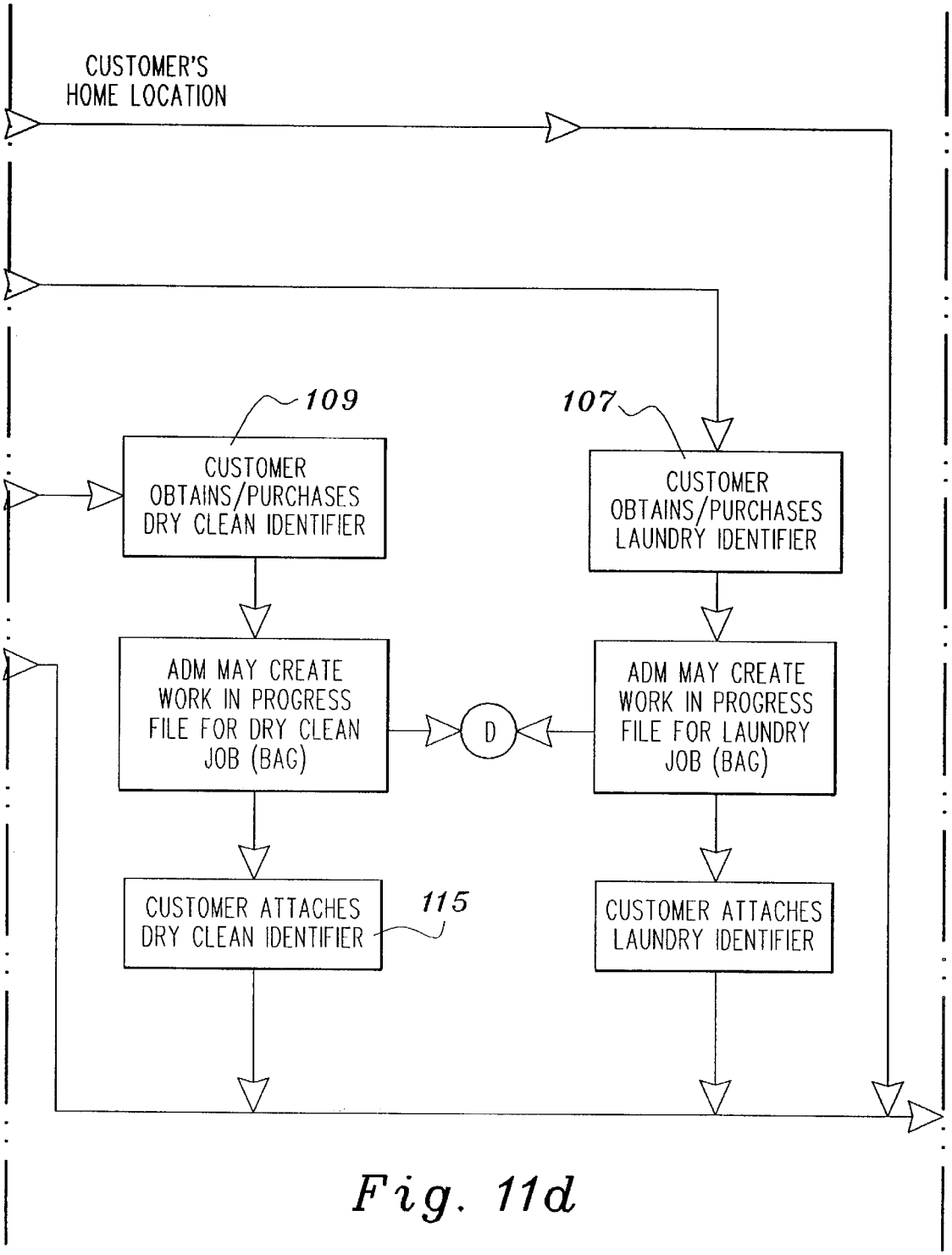
Figure 11E:
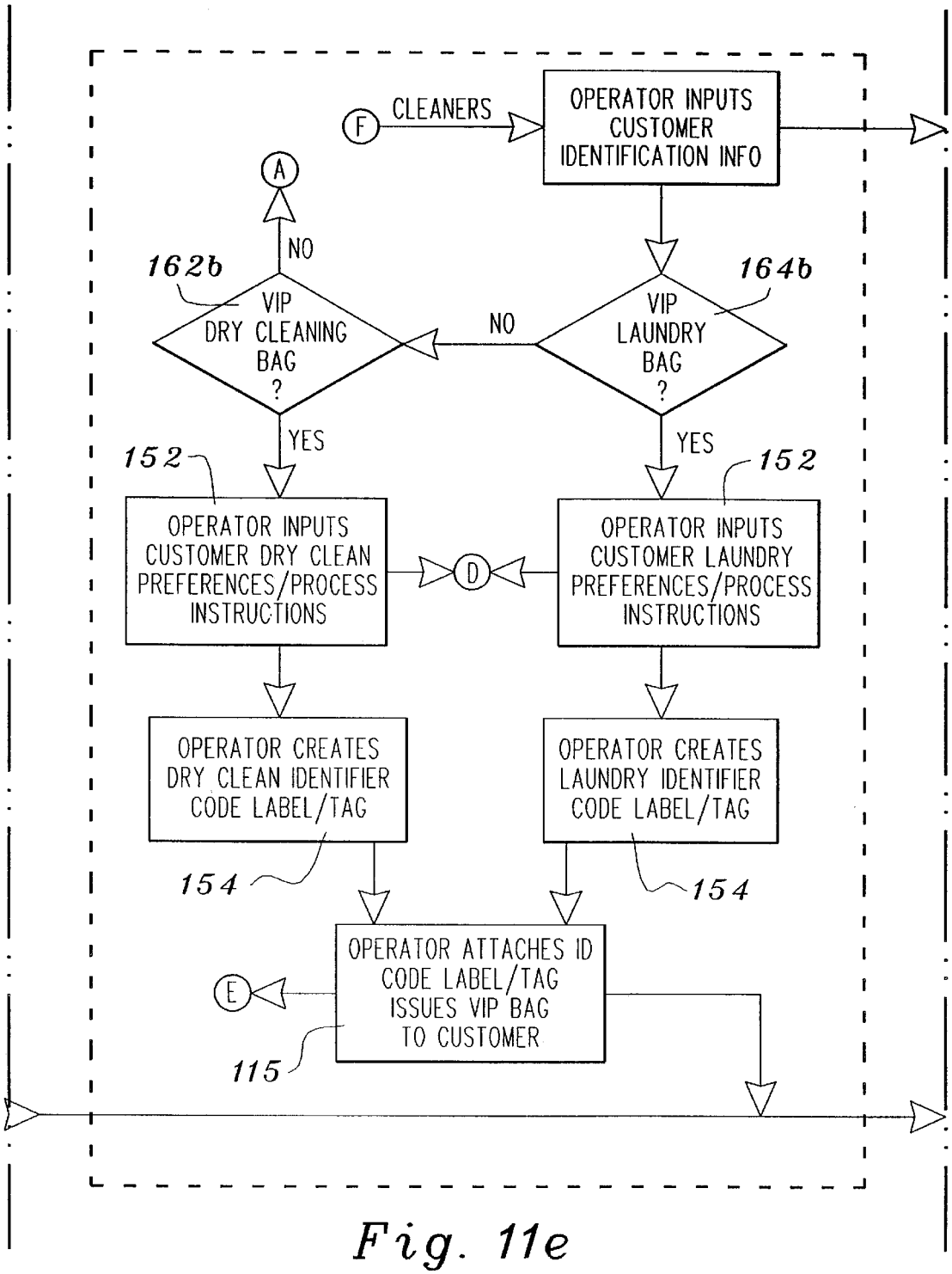
Figure 11F:
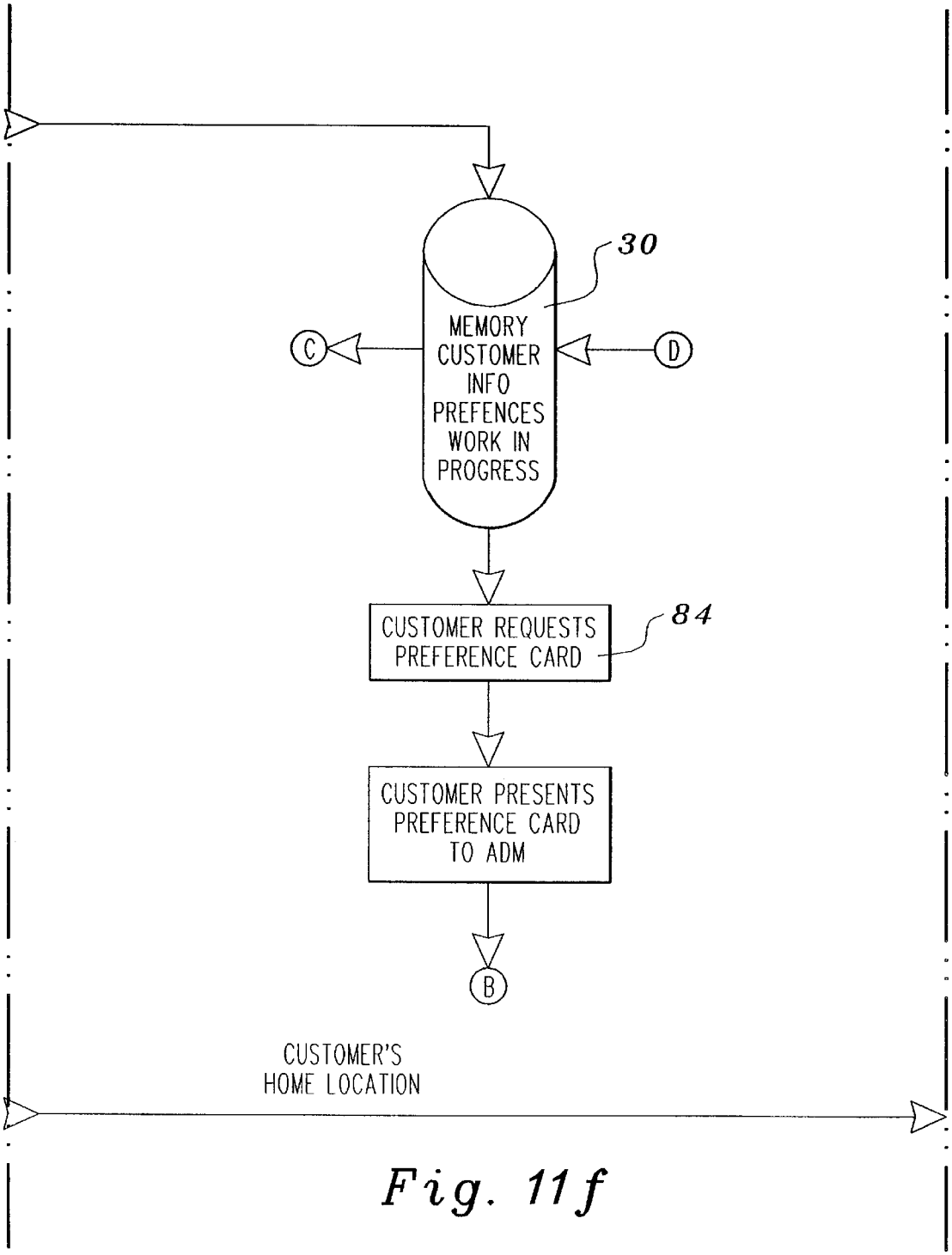
Figure 11G:
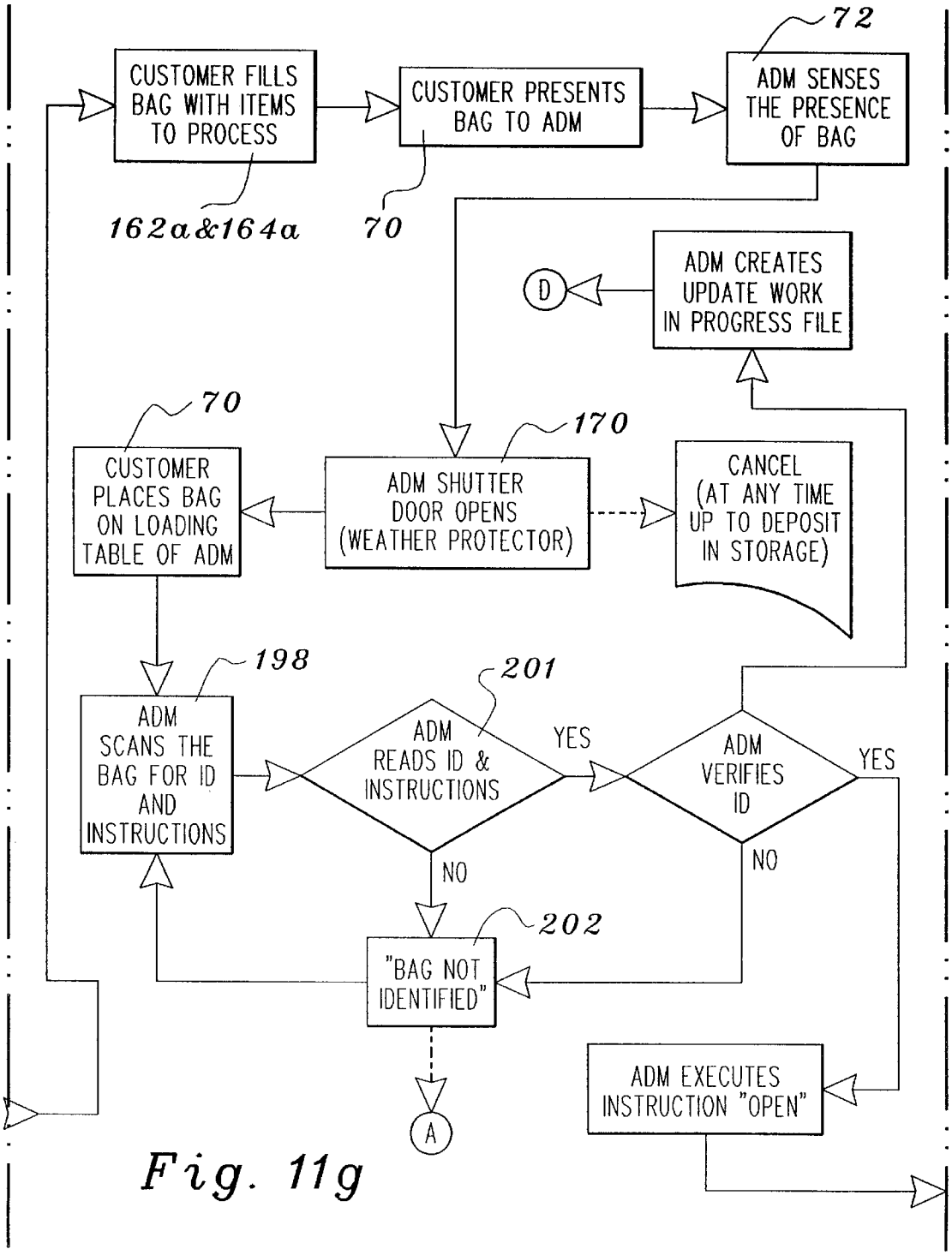
Figure 11H:
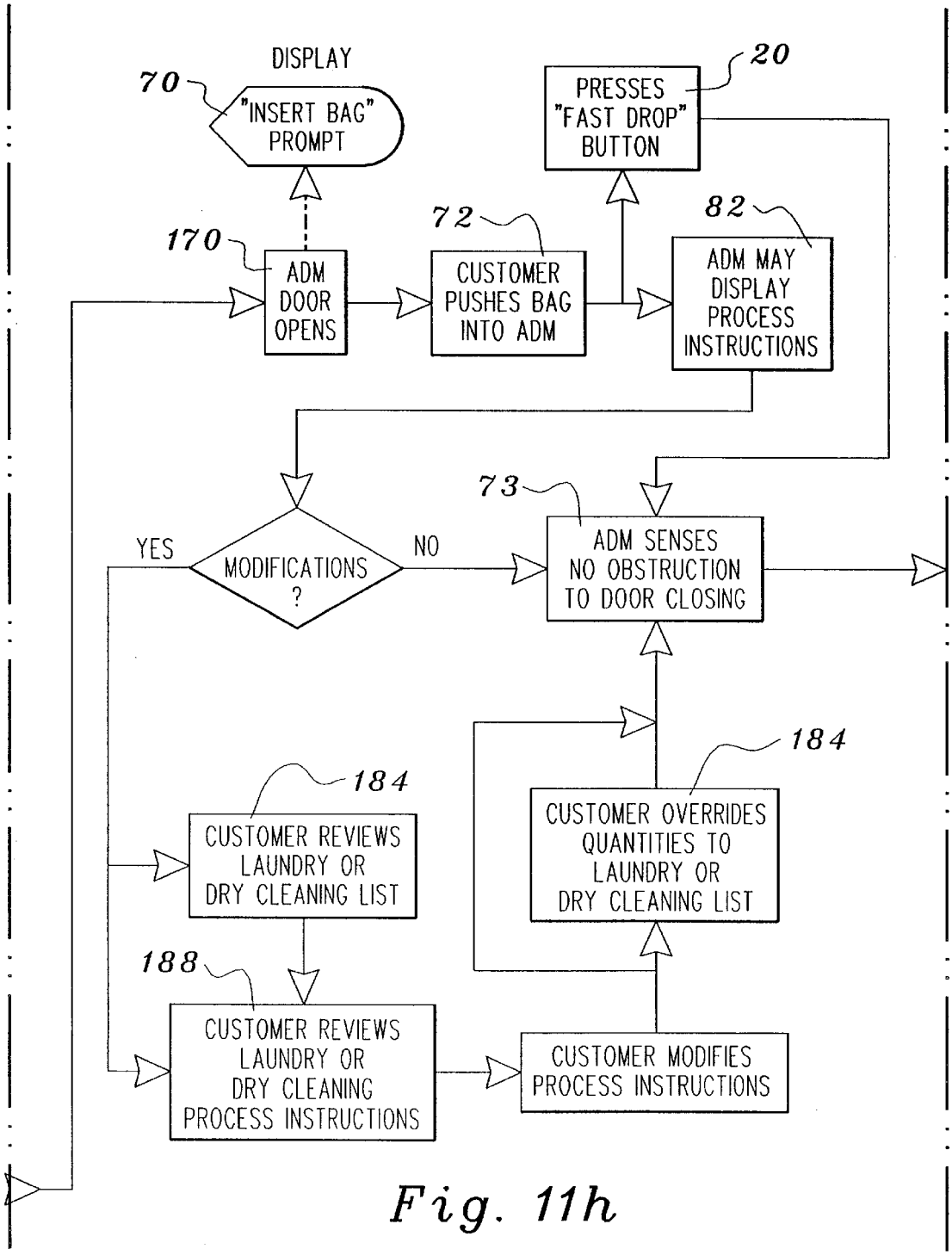
Figure 11I:
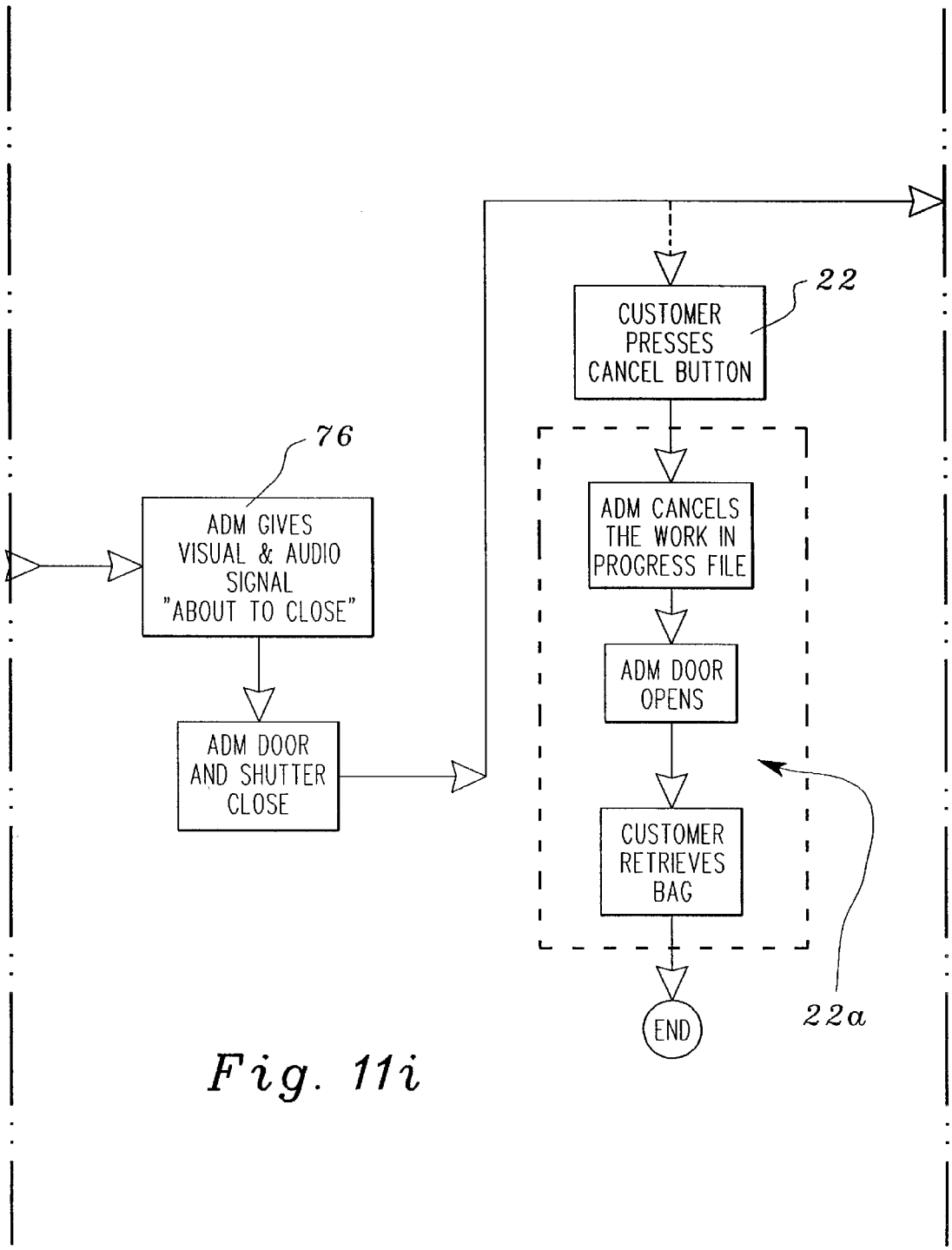
Figure 11J:
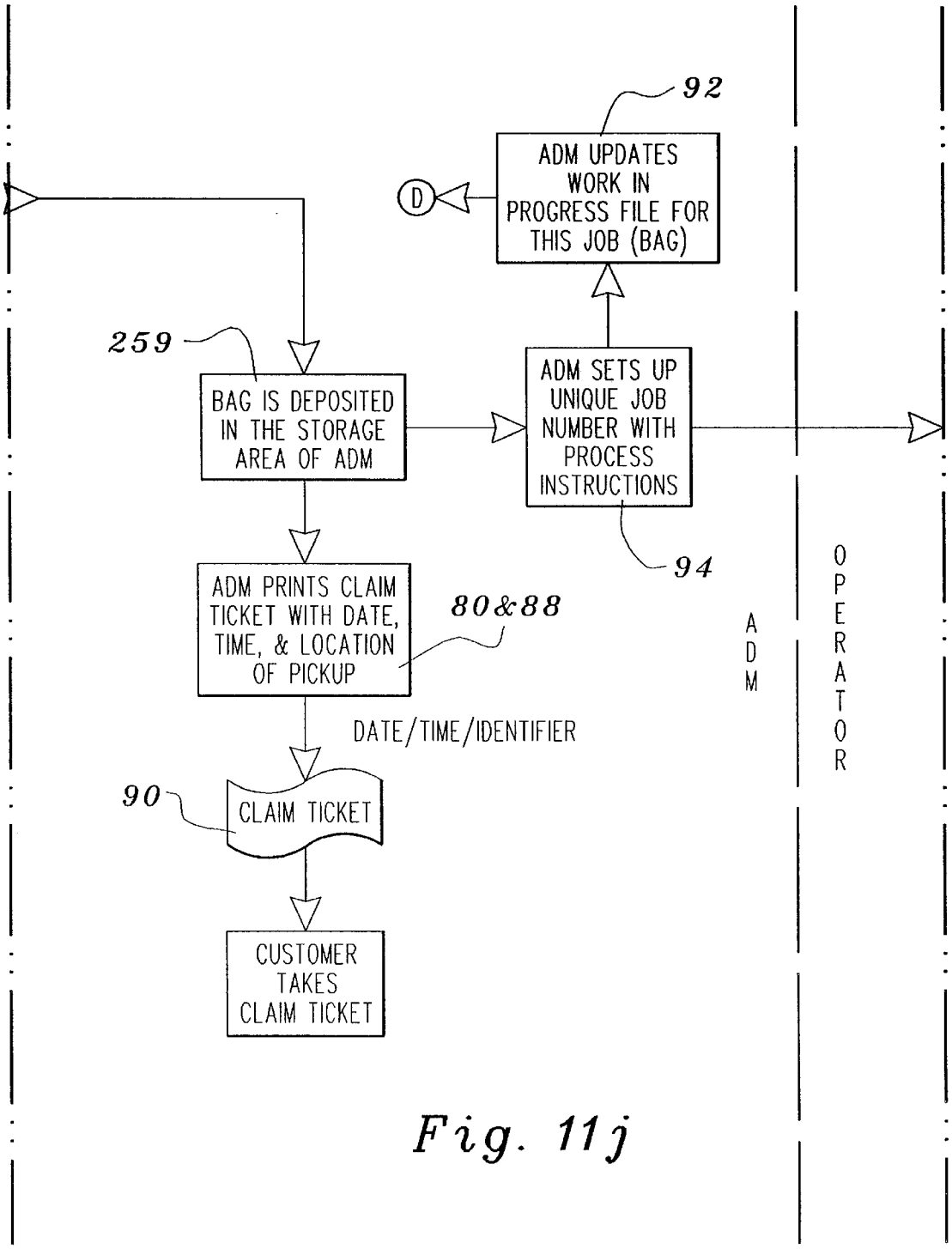
Figure 11K:
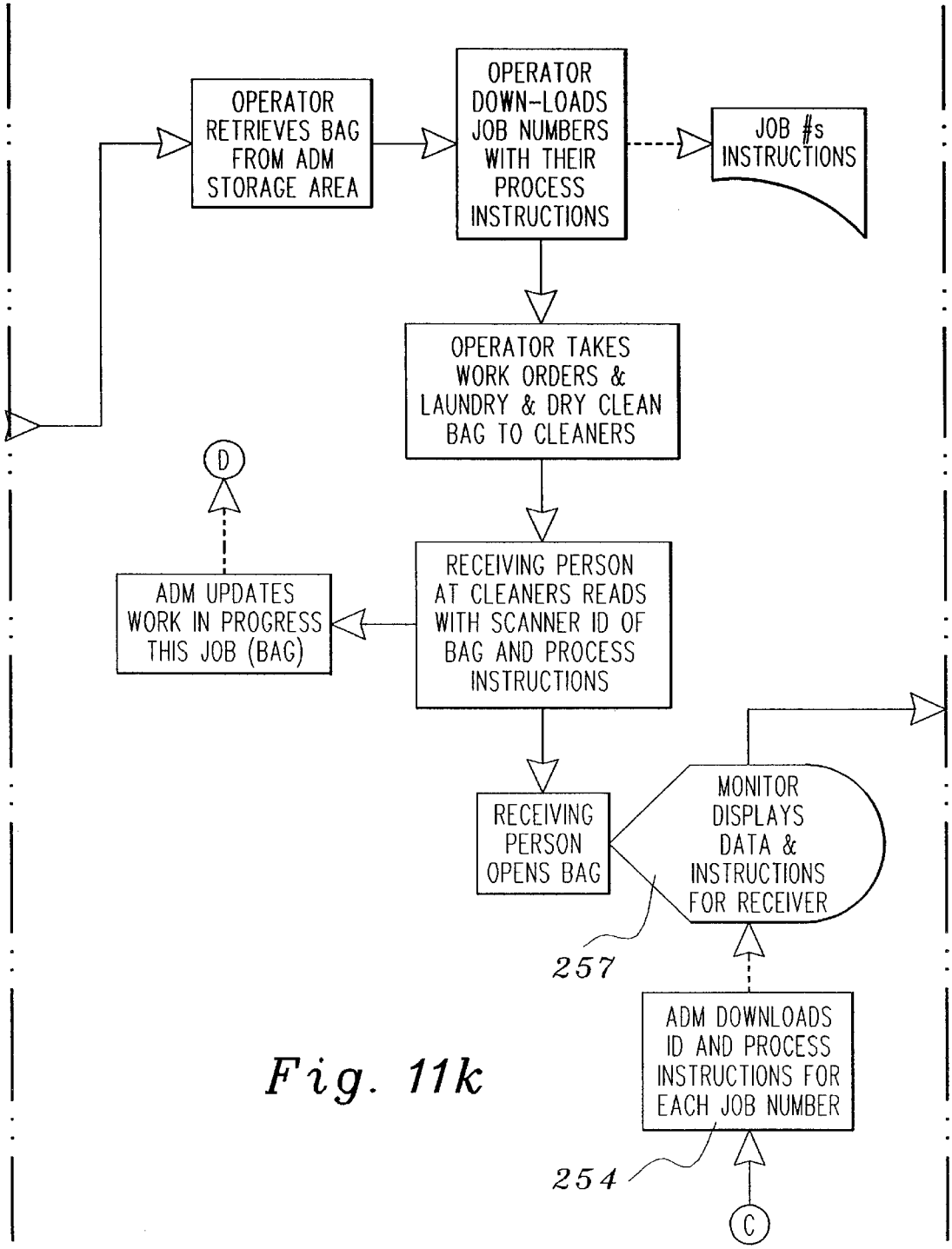
Figure 11L:
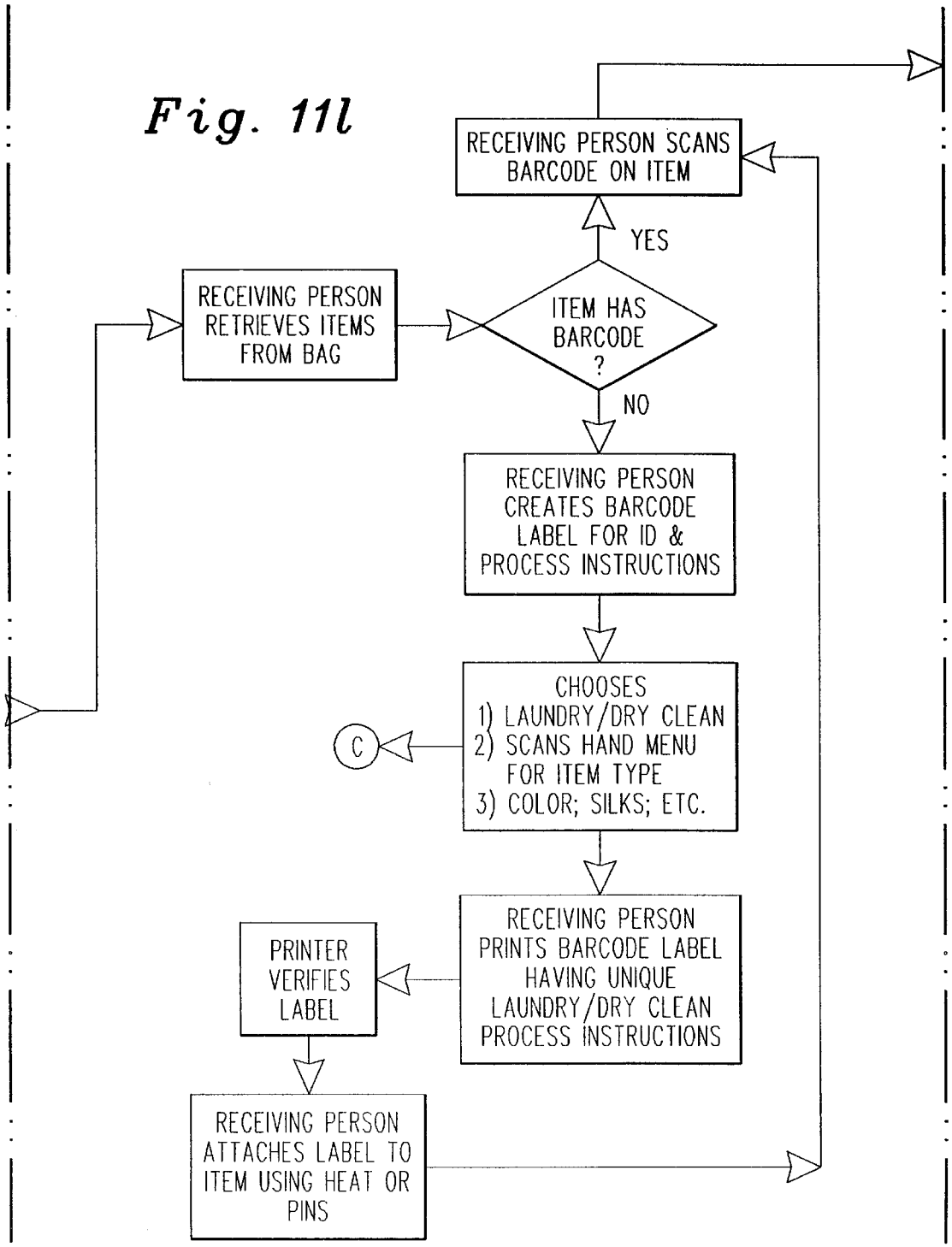
Figure 11M:
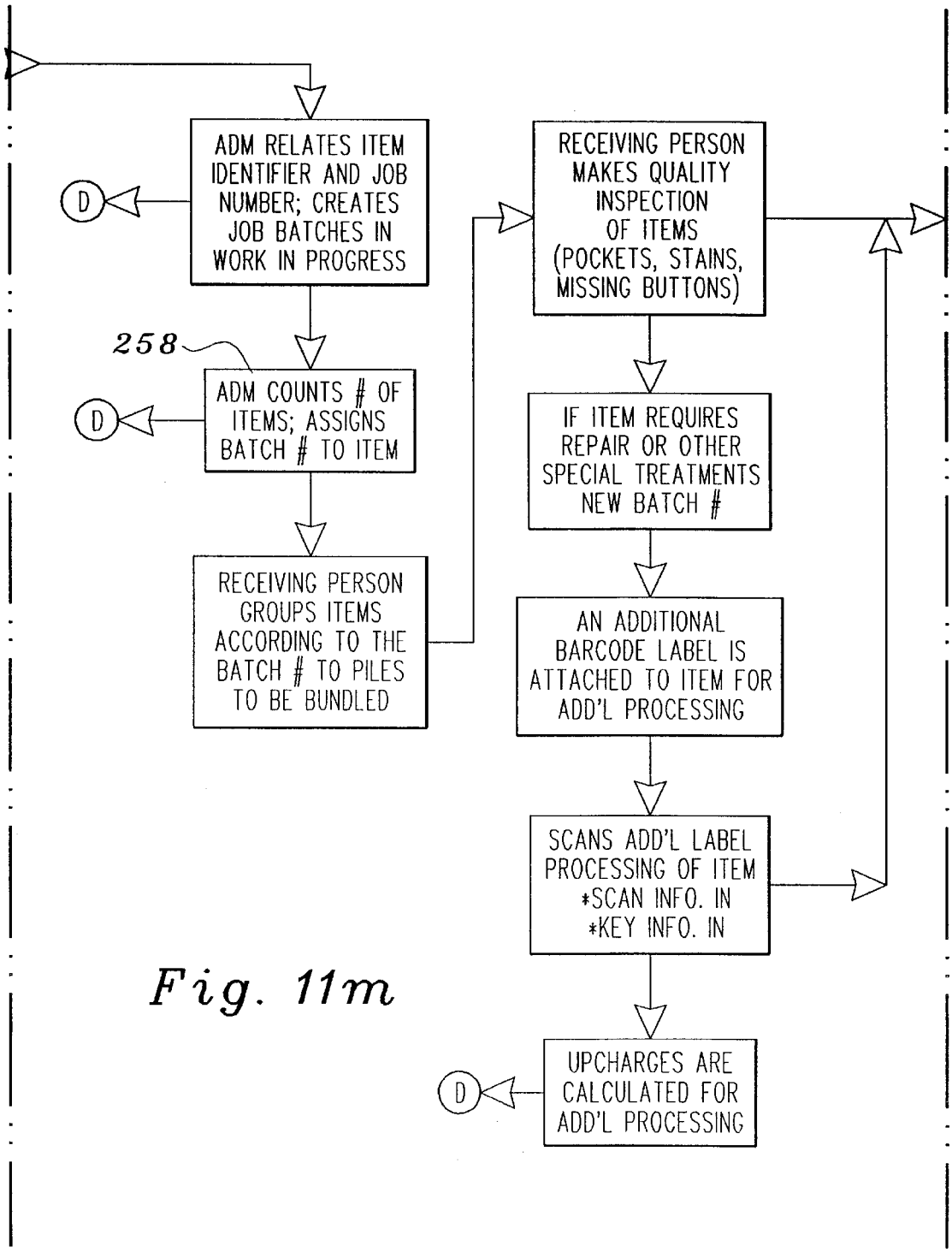
Figure 11N:
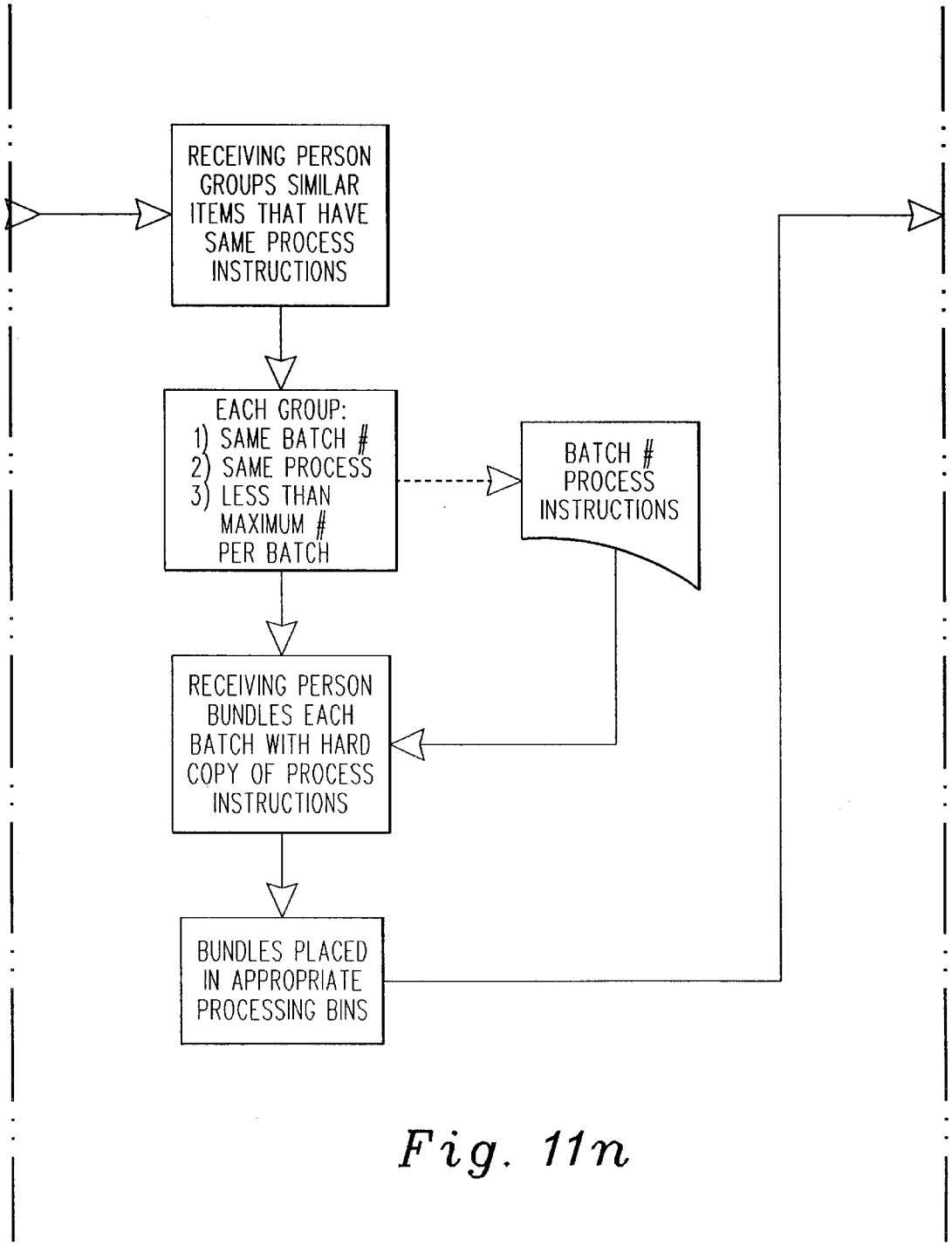
Figure 11O:
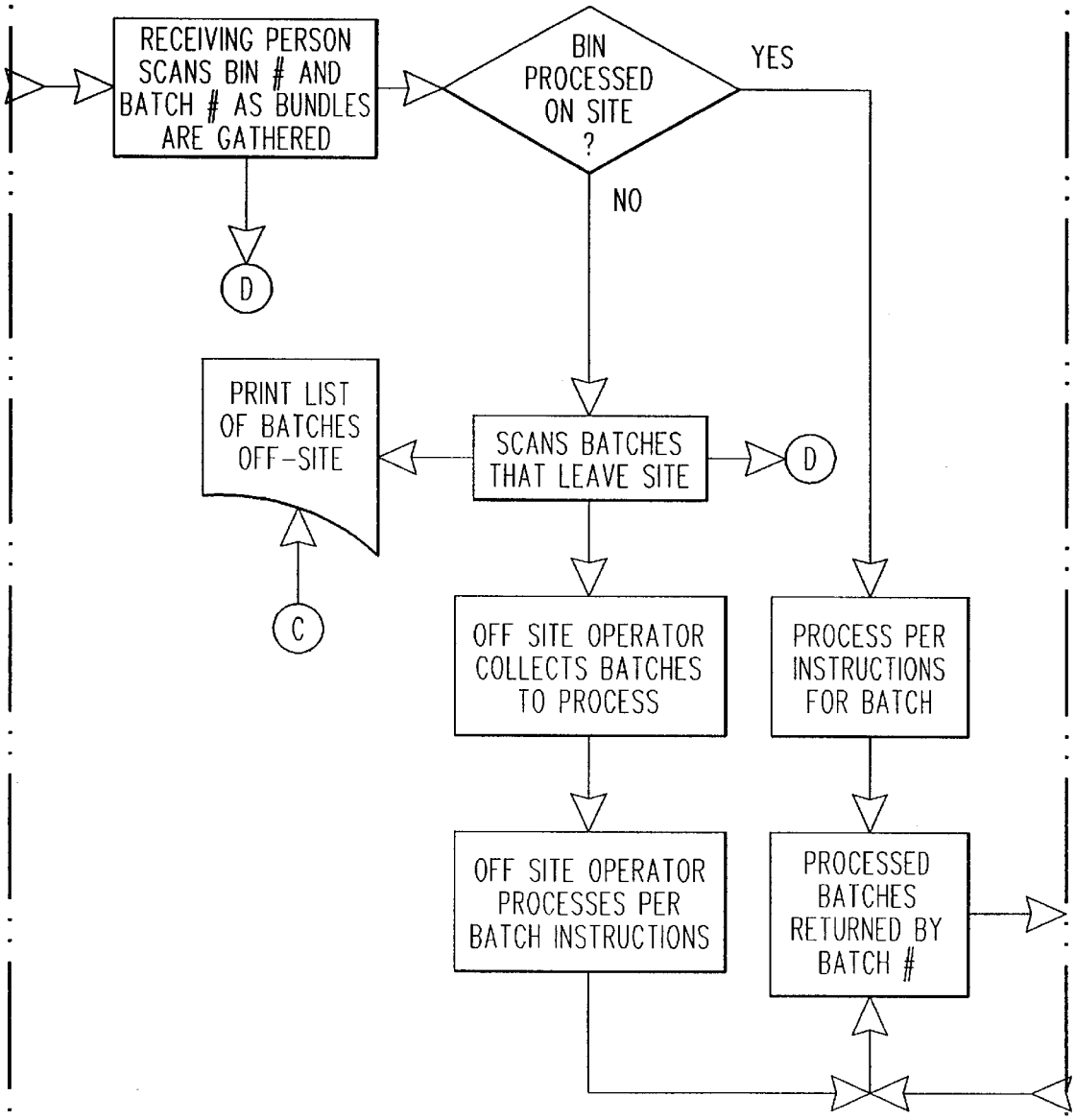
Figure 11P:
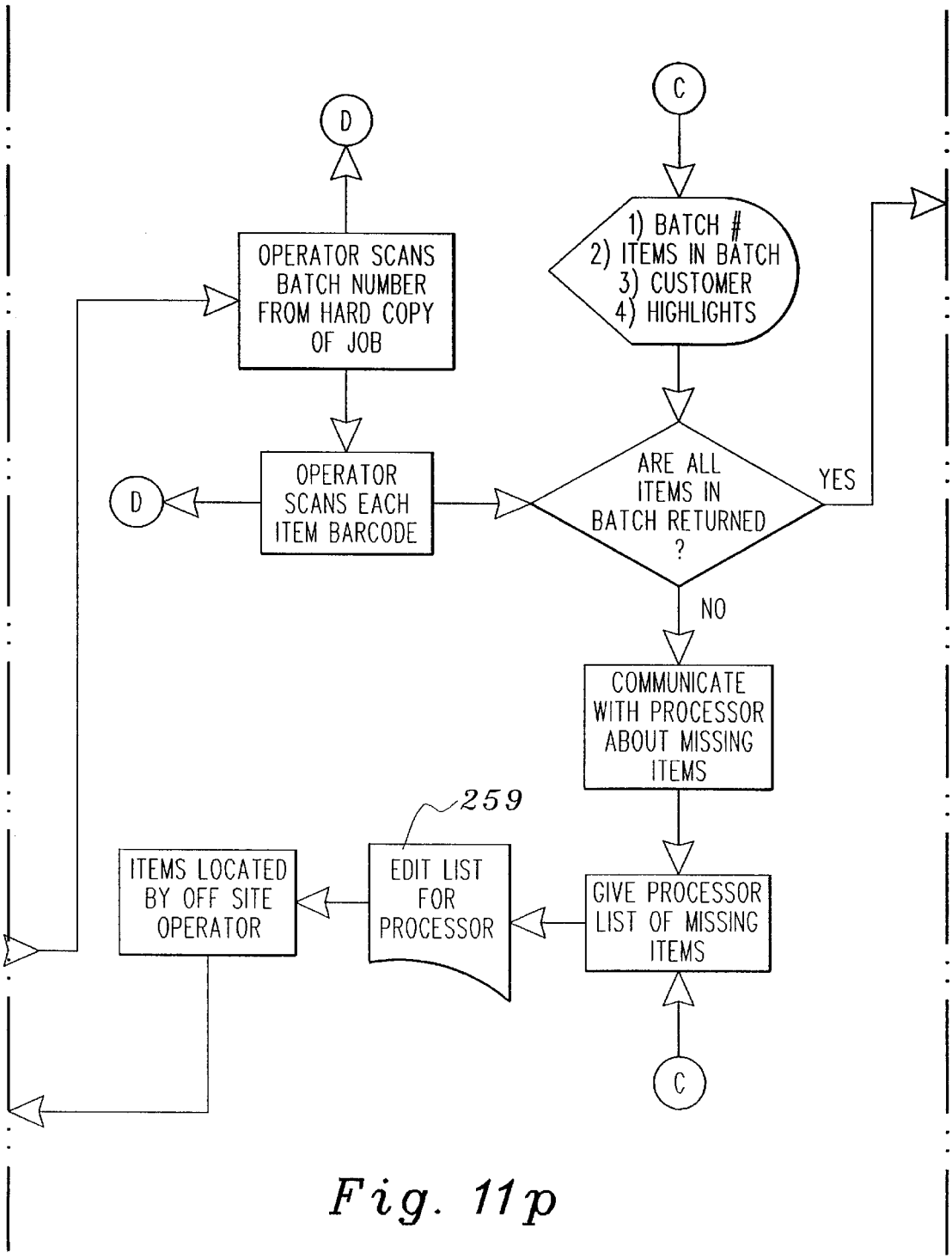
Figure 11Q:
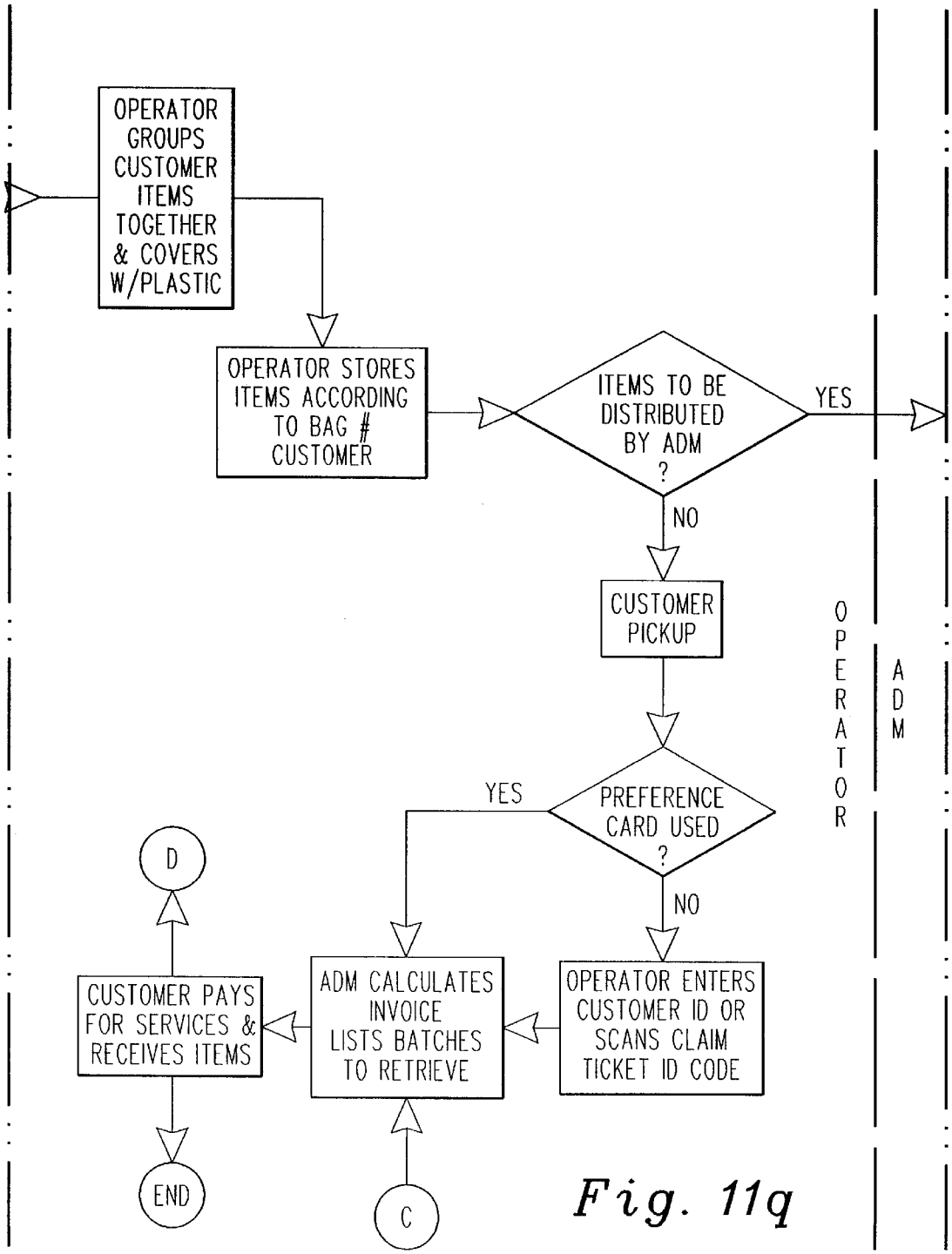

The laundry and dry cleaning ADM flowsheets of FIGS. 10*a*–10*j* present the flowsheet functions as follows:

FIGS. 11*a–b,* bag procurement;

FIGS. 11*c–d,* bag identification;

FIGS. 11*e–f,* operator created express bag;

FIGS. 11*g,* ADM identifies bag;

FIGS. 11*h–j,* deposit of bag and review of instructions;

FIGS. 11*k,* routing and ADM/operator interface;

FIGS. 11*l–m,* item Identification and processing;

FIGS. 11*n–o,* process grouping;

FIGS. 11*p–q,* operator finishing and distribution; and

Figure 11R:
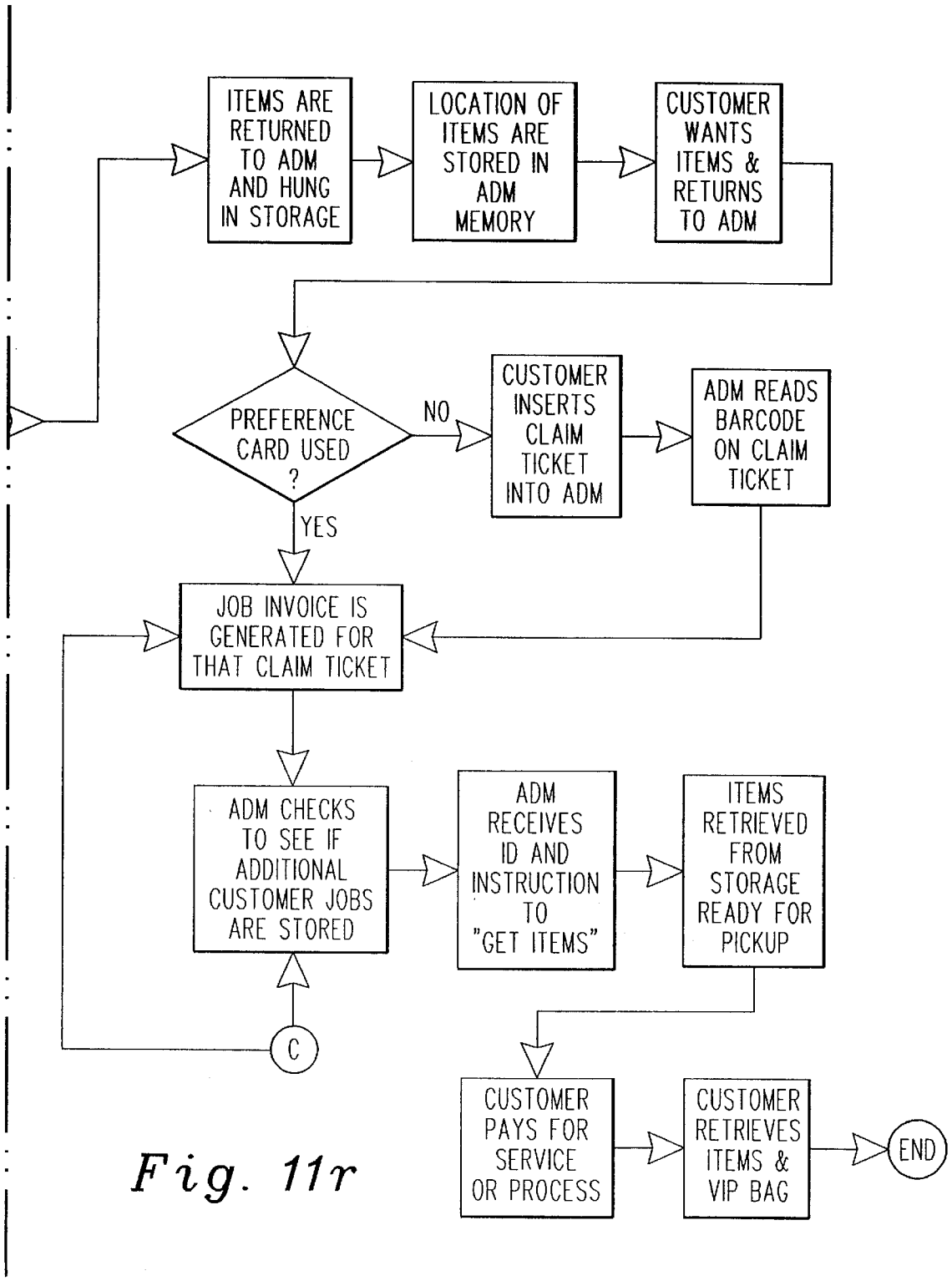

FIGS. 11*r,* ADM distribution.

The automatic item-driven system for deposit and pick-up of laundry and dry cleaning as illustrated by the flowsheet shown in FIGS. 11*a–r* further set out functional elements A–E as follows:

A. system default return to manual use;

B. preferred customer card source;

C. output from memory;

D. input to memory;

E. VIP bag issued from cleaners.

The flowsheet illustrated by FIGS. 11*a–r* can represent a continuous ADM system for consumer interface with the system, operator interface with the system and return of finished job goods to the customer; however, within the flowsheet, various stops are as indicated wherein the procedure is rejected by insufficient information, inappropriate processing and the like. In the flowsheet, the rectangular informational flowsheet items provide information utilized for following the flow of the flowsheet in defining an ADM methodology and apparatus relationship in accordance with the present Invention. Where the flowsheet presents diamond-shaped segments, these diamond-shaped segments indicate decision points along the line of the ADM process.

In a preferred embodiment, the ADM apparatus is comprised of a housing 3 having a defined door to a defined compartment with both frontal access openings and rear discharge openings; actuator operated doors 8 for maintaining the doors closed until the respective activating signal is received; a method for detecting 10 or receiving 36 a bar code or a transmitter attached associated with or embedded in the items to be deposited 162*b,* 164*b;* a signal containing characteristic information and process instructions about the items 16*c,* 164*c*. In addition, the ADM has an information reading unit 36 for receiving characteristic information and process instructions by reading from a magnetic recording medium such as a computer disk or tape, a laser disk medium, magnetic strip card medium and the like. A memory unit 30 storing translation information is used to decode information from various sources and is utilized along with a control unit 32 adapted to select corresponding controlling information from the memory unit. A method for transmitting information to a customer or user by printed medium 16 or display means 12 presents communication with a computer via interface 34 with the user. A transmitting unit 40 adapted to select the corresponding output on the basis of the characteristic information received causes the printer to print the information on paper 16 by recording the information on a magnetic tape or computer disk by communicating with a computer.

These various elements can also include a keyboard 14 for entering information to modify the quantities and process instructions 208, 210 given by the items to be deposited, update the laundry or dry cleaning list with item description selection and quantities 208 or make a functional selection such as purchasing stamps. In another aspect, the ADM can include a display unit comprised of a visible display 12 of the process information and laundry or dry cleaning list and an audio confirmation and guidance display 190, 220 adapted to receive and display confirmation and guidance information received in at least two languages which are selected according to the item's characteristic information. The ADM can utilize a display unit including a visible confirmation and guidance display and an audio confirmation and guidance display adapted to receive and display confirmation and guidance information received in at least two languages which is selected according to the item's characteristic information.

The ADM can have the ability to switch from the visible confirmation and guidance display to audio confirmation and guidance upon reception of characteristic information. The ADM can also provide a receipt issuing unit 16 for printing a transaction content and for issuing a receipt on which the transaction content is printed. The receipt issuing unit for printing is controlled to print the transaction content in a selected one of at least two languages, 220 which is selected according to the specific item's characteristic information. A container dispensing mechanism 5 or means for dispensing a container for items 6 to be placed in and deposited is readily adapted to be an integral part of the ADM 2 through utilization of a companion container. In addition, the container uniquely identified with the positive ID 115, 166, 198 is used to hold the items to be deposited. A receiving means for inserting completed response forms completed with a reading unit are also available. The ADM mechanically has means that can orient the items or container to be scanned or, using self orienting scanners, which are well known in the art, orient the scanner to find and read the bar code of the items to be deposited. The ADM can be given oral guidance or visual guidance information 76 for positioning the drop bag in the apparatus for deposit. A movable, lockable shutter (door) 56 covering the receiving ports of the ADM is used to protect them from the elements, or an exterior lip is used to serve as a rain guard. A coin and currency acceptance and dispensing means 24 are logically interconnected and controlled by microprocessor means comprising a primary controller located in the main part of the ADM allows for dispensing of stamps, tickets, vouchers, coupons and the like located to one side. As shown in FIG. 1, the ADM can be installed in an opening in the wall of the building such as an office and the ADM can be a stand alone unit that can be a permanent or movable structure. In addition, the ADM can be installed in a movable vehicle such as a van with the lighting around and near the ADM provided for security reasons as well as to draw attention to the apparatus.

The ADM with a location appropriate for posting notices such as pick up times, advertisement, cleaners names or instructions is desirable, and the ADM provides a system for tracking an article through the deposit system employing a plurality of uniquely identified steps as shown and described in FIGS. 11*a* through 11*r*. The ADM initiates the required coding 253 to continue the cleaning process. The ADM has a time keeping means 88 to post the times for all transactions and the ability to assign transaction numbers 94 as well as a customer number. A printer unit is available for printing reports, bar codes and schedules with the ability to print on [items deposited] on the containers used for deposit.

The ADM has the ability to query the memory for a particular item's history 254. The ADM has a cabinet and container assembly 3 for the deposit of items. The outer cabinet 3 defines an interior region which is generally closed. The outer cabinet has a pair of opposite side walls, a front wall, a rear wall and a top wall, thus describing the outer cabinet. An actuator operated door means wherein the cradle 8 can be pivotally connected to and mounted on the outer cabinet is closely adjacent to the front opening so as to be movable between a closed position in a covering relationship to the front opening and a receiving position displayed from the closed position. The cradle 8 defines a front section and a rear section, the front section and the rear section defining a chute surface extending generally therebetween. The front section forming a generally horizontal tray when the cradle 8 is in the receiving position such that the load of items, drop bags, may be placed thereon where the load of items sliding on the chute surface from the front section to the rear section across the rear edge as the cradle is pivoted to a closed position. The items will fold downwardly and be deposited within a rectangular region of the movable container. A portion of the rear section is contacting a portion of the outer cabinet when the cradle 8 is in the receiving position to prevent the cradle from being pivoted forward or downward substantially beyond the receiving position forming generally the horizontal tray or cradle. The rear section of the cradle 8 has a rear edge and being oriented in a generally downwardly angled direction when the cradle is in the closed position. The rear door is mounted on the cabinet closely adjacent to the rear opening so as to be removable between a closed position in covering relation to the rear opening and a receiving position displayed from the cradle closed position. The ADM can also have a movable container with a generally open top in defining a receptacle region being dimensioned so as to be removable received within the interior region of the outer cabinet through an opening when the second door is in the open position. It is a cart that rolls out for the retrieval of the deposit drop bags.

A remote control monitor unit is for observing the operational condition of a plurality of units of the apparatus by a person in charge whenever the characteristic information on the recording medium indicates an item, the display unit transmitting to the monitor unit information indicating the ADM should be attended to collect the drop bags or ill the event there is a problem like an insufficient supply of drop bags or the receipt printer is low on paper.

A diverting unit 300 to separate the types of items according to their characteristic information read by the ADM is also provided. As is shown in FIG. 11, the diverting unit comprises a pivotally mounted rectangularly shaped deflector 305 which is positioned below the interior portion of cradle 8 and is attached along one edge 307 to pivot rod 309 which is, in turn either attached to or is a part of the drive shaft 311 of a reversible propulsion means 313. The reversible propulsion means could be an electric servo motor, or any other reversible propulsion means commonly known in the art. The propulsion means responds to directions from the ADM computer to rotate deflector 305 through a defined arc 0 thereby orienting deflector 305 to send deposited items such as laundry or dry cleaning to the proper segregated storage means, or segregating for example unrewound video cassettes from rewound video cassettes. The ADM is the receiving and marking of items to be processed in a system. The ADM is used in conjunction with the distributing unit, remote locations, or a point of sale (POS) device. The ADM responds initially with two customer options: the fast drop route 20, and drop with edited instructions/list 14. The fast drop route 20 is always an option at any point in the deposit process such as during the editing of instructions phase regardless of initial choice of routes After the cradle 8 is opened, depression of the fast drop button will cause the cradle 8 to close and continue the deposit process. Upon completion of closure of the cradle a receipt is printed. Cancel 22 is always an option prior to the ADM door closing and the dirty clothes deposited. If the fast drop route 20 is chosen by the customer, a door 8 will open 170 and a drop bag is pushed 70 through the open door. The door will remain open a few seconds after the bag is deposited to allow all of the bag to be passed through the door before closing. After the door closes, the ADM queries the customer for prepay options 84. Then the receipt is printed and made available for the customer to take with him showing the pick-up location, pick-up time, pick-up number, time and date of deposit and proof of prepayment 88. This functions as a claim check. An advantage is that if the pick up location will be closed for a holiday, the pick up date and time can reflect this modification. For example, the receipt for videos indicating video return dates is modified if desired according to a weekend such as a three day rate or a week day two day rate or a one day rate. Signs can also be posted as reminders to the customer but the confirmation is on the receipt. Other information that might be printed on the receipt includes customer's name, whether it is dry cleaning or laundry and/or the bag number on the drop bag, but for security reasons it might not be desirable to print the bar code or RF/ID number. An additional concept and utilization of the ADM would be for the identifier on the bag to specify the type of item enclosed in the bag. For example, the identifier could identify ladies' dresses and only ladies' dresses should be in that particular bag. This would be an example of presorting by the customer and communicated by the identifier on or incorporated within the bag, thus eliminating a step of sorting bag contents at the cleaners. For this to work effectively, each dress would need to have its own unique bar code or Radio Frequency (RF) identifier which tie it to the customer, its own processing instructions and the like. Another concept would be for the identifier on the bag to specify the type and number of the items in the drop bag. For example, a drop bag identifier might specify men's jeans with maximum number. So when the bag reaches this maximum batch quantity, for example, seven jeans, the customer could deposit the bag with assurance of processing. The advantage to the cleaners is that the bag is ready for processing and does not require additional sorting. The cleaners could offer the customer a price break for this presorting.

If DROP WITH INSTRUCTIONS is selected, the identifier on the bag selects a laundry list of items commonly found in bags as a default 184 or selects items found in this bag according to history. The last item on the list is "OTHERS" that will add additional items to the list by selection. The customer selects quantity numbers for each item 208; however, if this process is lengthier or more cumbersome than the customer desires, he can at any point in the process always select the "FAST DROP" option 20 and the door will open immediately 170. Once the list of items and quantities are selected, the customer is presented by ADM with a list displaying the chosen items and quantities. Then ADM will query the customer to either CONFIRM 188 in order to proceed or return to previous screen to edit/change list. When customer confirms list, the ADM queries the customer as to processing instructions: STANDING ORDERS as a default will be displayed 82. For example, if the item- is men's white shirts, the Standing Orders may be "laundered, medium starch, hangers" and the customer can accept this default. However, if the customer wishes to change this processing instructions for this particular item, he can select CHANGE (override) to EDIT the processing instructions 206, 208. For example, the above order for the item of men's white shirts can be edited to the Standing Orders of "laundered, heavy starch, folded, treat collars". These standing orders are derived from a bank of common processing requests by customers. The edited processing instructions are confirmed by the customer 212. The door will open to accept the bag 170. The customer pushes the bag through 70. After a few seconds, the door will close 78. The customer will receive a print-out/receipt/claim check with information chosen from a data base 90 such as the confirmed list of items with quantities, date and time of deposit, date and time for pick-up of clothes, location of pick-up, the cost, pick-up number unique to each receipt, the bag number, and customer name and number. Of course, additional information could be on the receipt; however, such as the messages from the cleaner, such as advertising, identifier, number on the bag, customer's address, phone number, driver's license, and social security number probably should not be on the receipt for security reasons. At this point, the ADM will query the customer as to desiring the PRE-PAY option 84 with the PRE-PAID COST displayed.

The ADM should be able to receive information such as list of contents 196, 198 inputed by operator personnel. The ADM should be able to read code that has specified contents in the DROP BAG 256, enter the list of contents manually by key pad 14, read a prepared laundry/dry cleaning list form inserted or scanned 10 or an identifier on each item, receive information from a computer via interface such as a modem or plug-in pen.

The ADM should be able to out-put information 16, display on a screen the list of contents 12 of a drop bag, print out a hard copy of the list of contents 16, down load the list of contents to a system, computer, etc. and from the same drop bag assign batches with list of contents per each 258.

PRE-PAY AT DROP-OFF option 84 is offered by the ADM after the door is closed before the receipt is printed. If PRE-PAY is not selected after several seconds, then the receipt is printed the transaction is complete, and the customer can leave. However, if PRE-PAY OPTIONS is selected then there are several choices of PRE-PAY to consider. PRE-PAY by bag, for example, 7 men's white shirts to be laundered could have a fixed price if a bag having an [bar code] identifier indicating 7 men's laundered shirts is used for a deposit. For example, the ADM could query, "Do you have 7 shirts?" If customer confirms, then the ADM calculates the price based on a full batch 84. This is based on the assumption that the bulk laundry can process a maximum batch cheaper per piece than a smaller batch (due to reducing set-up). If it is not a full batch, then the ADM queries for quantity. The customer can then pre-pay by items. In PRE-PAY by items, the identifier in or on the drop bag indicates the type of items and process instructions to be used; the ADM queries the quantity; the customer edits the quantity; the ADM calculates the price and displays the PRE-PAID COST. If a generic drop-bag contains a mixture of items (such as jeans, shirts) to be laundered or a mixture of items (blouses, suits) to be dry cleaned, then the ADM will present a laundry/dry cleaning list for editing of items and quantities. After the customer has edited the appropriate items and quantities, the ADM calculates the total to be pre-paid and displays the PRE-PAID COST. To allow the Customer one last chance to change his mind after the PRE-PAID COST is displayed, there could be a menu displayed to confirm that he desires to prepay (Pay Now) or wishes to pay at pickup (Pay Later). This could also be indicated by the Customer either proceeding to the Payment or canceling the Pre-Pay choice. PRE-PAY PAYMENT can use coins, bills or vouchers. The ADM can give change or vouchers. Provisions for payment and change will be located on the front of the ADM 24. The customer can also use credit cards, Smart cards, stored value cards, and bank debit cards such as Visa®, Master Card®, Discover®, PULSE® and the like.

Additional advantages and modifications will readily occur to those skilled in the art. Therefore, the Invention in its broader aspects is not limited to the specific details, and representative devices and methodologies shown are described herein. Accordingly, various modifications may be made without departing from the spirit or scope of the general inventive concept as defined by the appended claims and their equivalents.

What is claimed is:

1. An automatic deposit and issue machine for depositing and issuing items wherein an actuator operated door means includes a cradle being pivotally connected to and mounted on an outer cabinet closely adjacent to the frontal first door so as to be movable between a closed position and covering relationship to a front door opening in the cabinet and a receiving position display from the closed position, the cradle defining a front section and a rear section, the front section and the rear section defining a chute surface extending generally therebetween, the front section forming a generally horizontal tray when the cradle is in the receiving position such that items to be deposited may be placed thereon where the items slide on the chute surface from the front section to a rear section across the rear edges as the cradle is pivoted to a closed position, a portion of the rear section is in contact with a portion of the outer cabinet when the cradle is in the receiving position to prevent the cradle from being pivoted forward or downward substantially beyond the receiving position, forming a horizontal tray or cradle, the rear section of the cradle having a rear edge in being oriented downwardly angled directed when the cradle is in the closed position.

2. The automatic deposit and issue machine for depositing and issuing items according to claim 1 wherein a movable container, a cart with side walls on rollers with an open top is positioned in the cabinet for receiving deposit items from the cradle chute and is readily removable through the second or rear door of the machine.

3. A method for receiving items to be processed in a job-driven environment providing item processing, storage and reissuing to appropriate customers in response to container-supplied information using an automatic depositing and reissuing machine, comprising:

receiving first input container-supplied information;

associating customer identification item characteristics and process instructions in response to first input information with each container storing items for processing;

creating and storing data relationship between customer identification, item characteristics, assigned processing, and first input information;

routing of items;

interfacing the automatic deposit machine and operator;

identifying and processing of items in accordance with customer-supplied item identification and process information;

finishing and distributing of items by the operator;

carrying the finished items within a finished item carrier; and storing the finished items and carrier.

4. The method for receiving items to be processed in a job-driven environment providing the item processing, storage and reissuing to appropriate customers according to claim 3 wherein after creating and storing data relationship between item identification, process information, which may include customer-supplied information, printing of a transaction summary including container-supplied information, item identification and process information stored in memory is provided.

5. The method for receiving items to be processed in a job-driven environment providing item processing, storing and reissuing to appropriate customers according to claim 3 wherein after identification and processing of items in accordance with container-supplied and item identification information, printing of a summary of processed items including a listing of container-supplied information and item identification information as well as processor charges and summaries are provided.

6. The method for receiving items to be processed in a job-driven environment providing item processing, storing and reissuing to appropriate customers according to claim 3 wherein the items are comprised of laundry and dry cleaning articles.

7. An automatic deposit machine having a inner secured volume defined by walls of a container assembly for the deposit of items including front and back walls, a top and a bottom and opposing side walls wherein an actuator operated door means mounted in a front door space in the front wall including a cradle pivotally connected to and mounted on the outer cabinet so as to be movable between a closed position in a covering relationship to said front door space and an open receiving position from the closed position, the cradle defining a front section and a rear section, the front section and the rear section defining a chute surface extending generally therebetween, the front section forming a generally horizontal tray when the cradle is in the receiving position such that items to be deposited may be placed thereon and where said items slide on the chute surface from the front section to the rear section and across the rear edges of the rear section as the cradle is pivoted to the closed position, a portion of the rear section being in contact with a portion of the outer cabinet when the cradle is in the receiving position to prevent the cradle from being pivoted forward or downward substantially beyond the receiving position, thereby forming a horizontal tray or cradle, the rear section of the cradle having a rear edge being oriented in a downwardly directed angle when the cradle is in the closed position.

8. The automatic deposit machine according to claim 7 wherein a moveable cart with side walls on rollers is positioned in the secured volume for receiving deposited items from the cradle chute.

* * * * *